US005682736A

United States Patent [19]

Chia et al.

[11] Patent Number: 5,682,736

[45] Date of Patent: Nov. 4, 1997

[54] ROPE CHAIN COMPONENT

[76] Inventors: Meang Chia; Cheo Chia, both of Chain & Charm Manufacturers 412 W. 6th St., Suite #1104, Los Angeles, Calif. 90014

[21] Appl. No.: 442,390

[22] Filed: May 16, 1995

Related U.S. Application Data

[63] Continuation-in-part of Ser. No. 224,669, Apr. 7, 1994, Pat. No. 5,542,244, which is a continuation of Ser. No. 899,742, Jun. 17, 1992, Pat. No. 5,301,498.

[51] Int. Cl.[6] ..... B21L 11/00

[52] U.S. Cl. ..... 59/35.1; 59/80; 59/93

[58] Field of Search ..... 59/3, 35.1, 78, 59/80, 82, 93, 95

[56] References Cited

U.S. PATENT DOCUMENTS

| | | | |
|---|---|---|---|
| 1,631,296 | 6/1927 | Smith | 59/80 |
| 5,301,498 | 4/1994 | Chia et al. | 59/80 |
| 5,542,244 | 8/1996 | Chia et al. | 59/80 |

OTHER PUBLICATIONS

Exhibit 1# Photograph of an item of jewelry purchased from Mervyns Dept. Store, Jul. 1991.

Exhibit 2# An advertisement for "Fancy Rope".

Exhibit 3# An advertisement for Figarope found in Oct. 1989 issue of Jewelers Circular–Keystone, Oct. 1989.

Exhibit 4# An advertisement depicting two chains (9th and 10th from the top) of interest (date unknown).

*Primary Examiner*—David Jones

*Attorney, Agent, or Firm*—Ladas & Parry

[57] ABSTRACT

The invention is a unitary component that may be substituted intermittently for portions of a jewelry rope chain. The unitary component has connecting means that promotes the integration of the component with the conventional rope chain by receiving onto the component the individual links of the rope chain in their ordinary sequence and position as those links are sequentially and positionally comprised on a conventional rope chain. The use of the component with conventional rope chain segments results in savings of precious metal and labor costs while retaining many of the flexibility and aesthetic advantages of the conventional rope chain. The preferred embodiment of the rope chain is spiral in shape but may take on various other configurations.

34 Claims, 22 Drawing Sheets

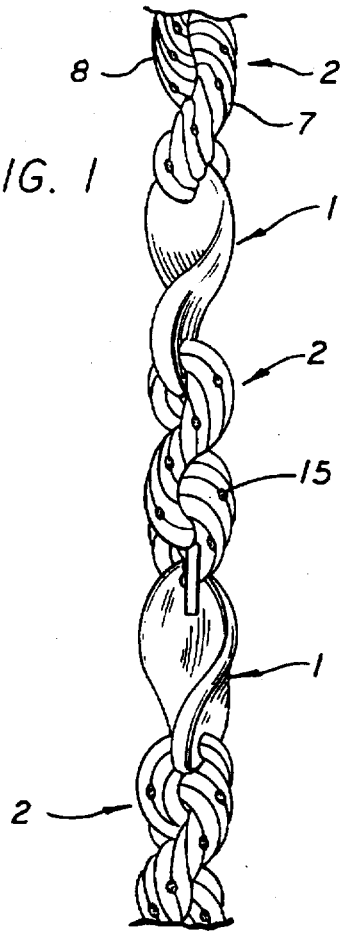
FIG. 1
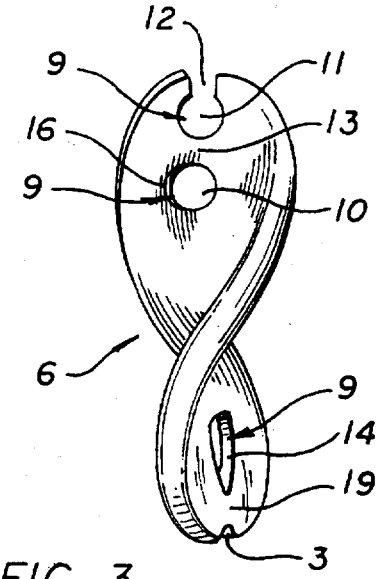
FIG. 3
FIG. 2
PRIOR ART
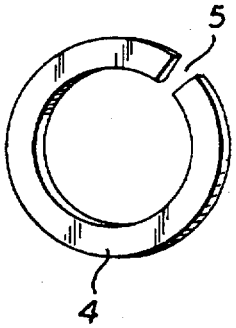
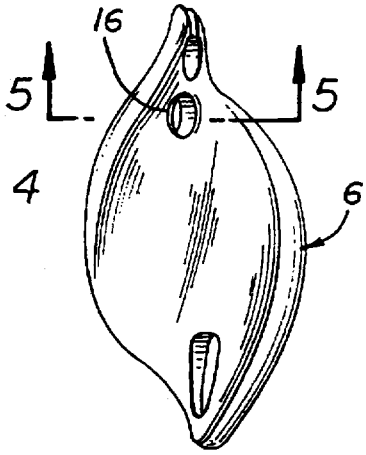
FIG. 4
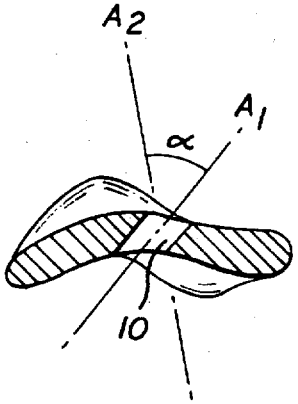
FIG. 5
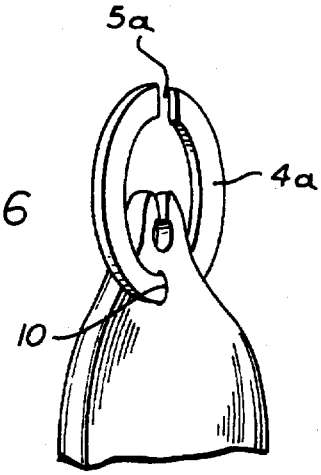
FIG. 6
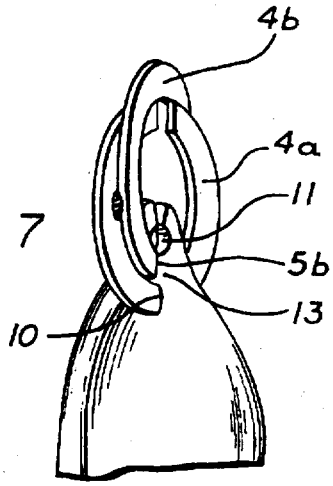
FIG. 7

FIG. 8
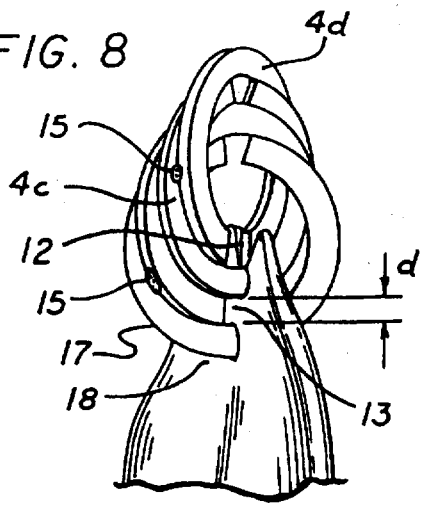
FIG. 9
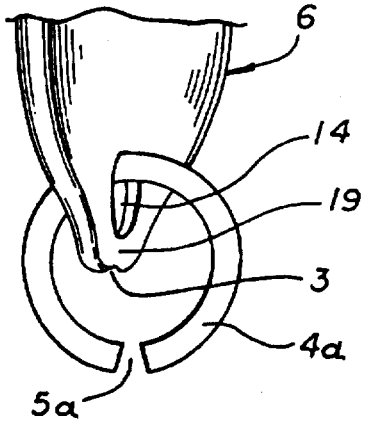
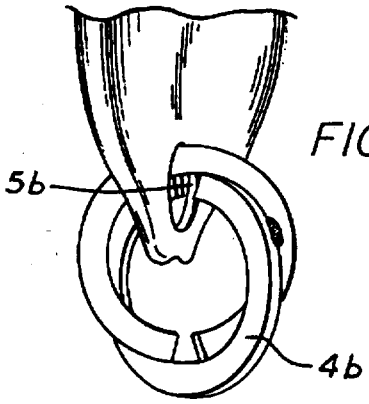
FIG. 10
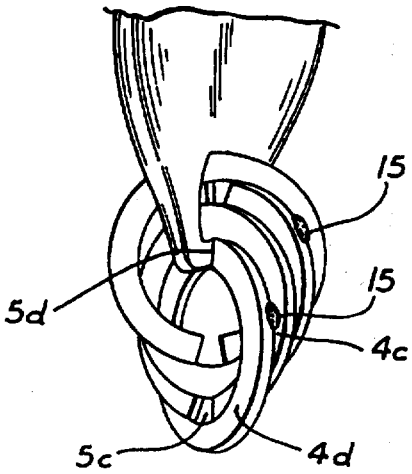
FIG. 11
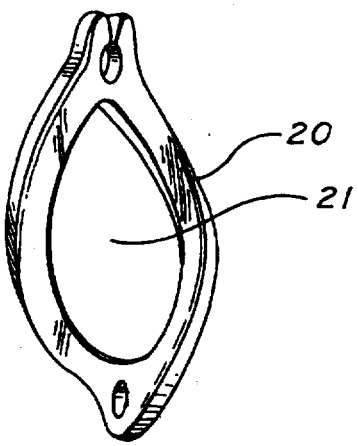
FIG. 12

FIG. 16
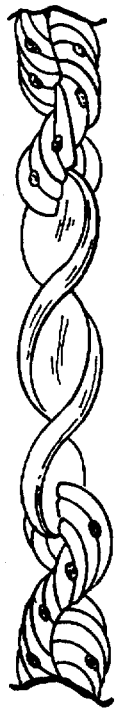
FIG. 17
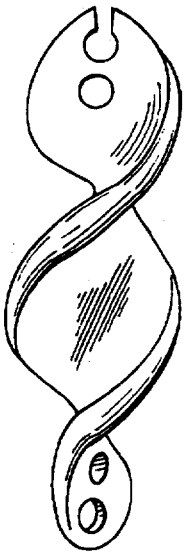
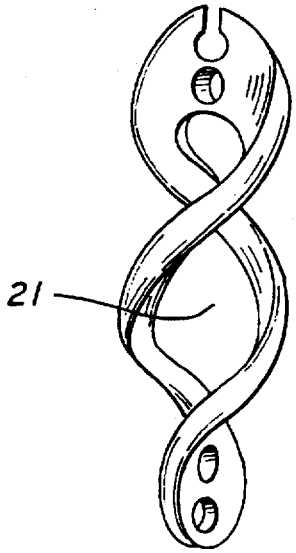
FIG. 18
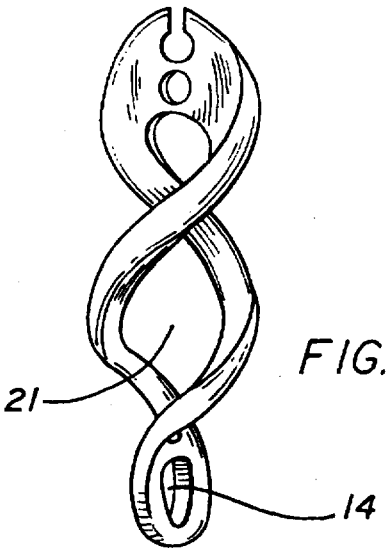
FIG. 19
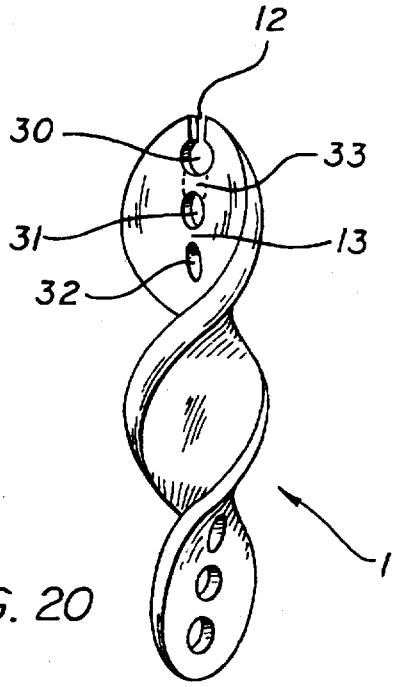
FIG. 20

FIG. 21
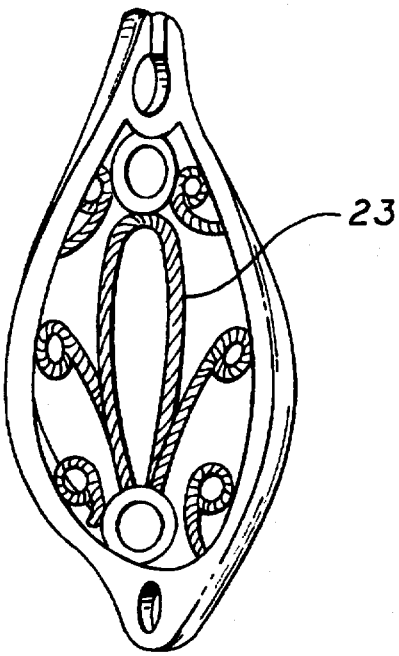
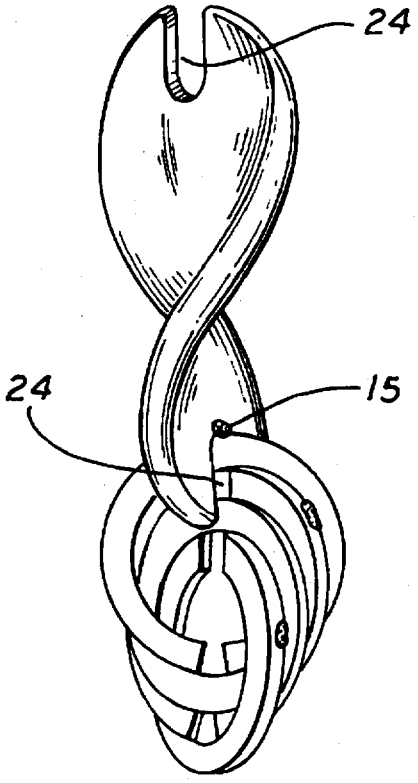
FIG. 22
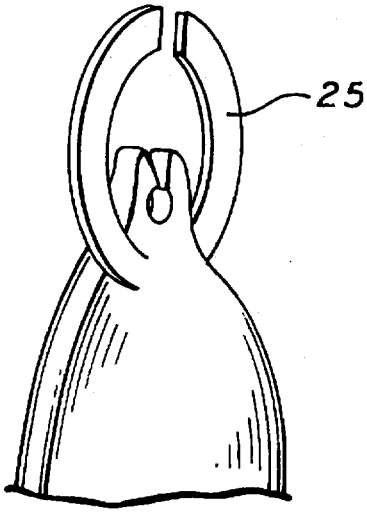
FIG. 23

FIG. 24
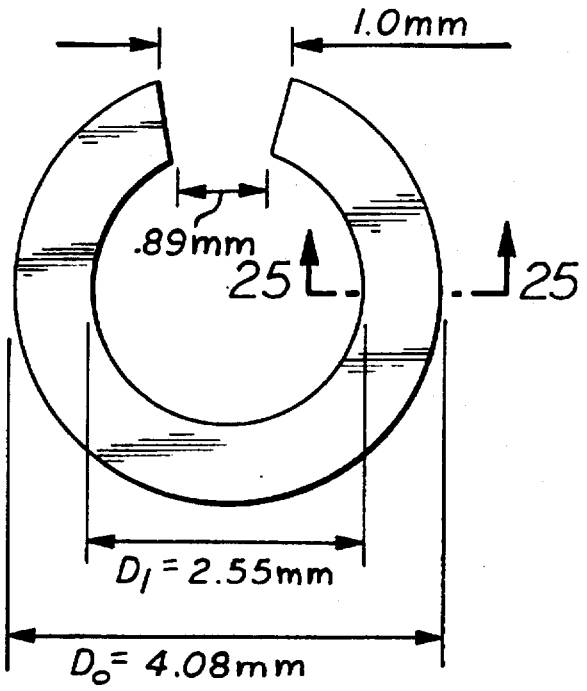
FIG. 26
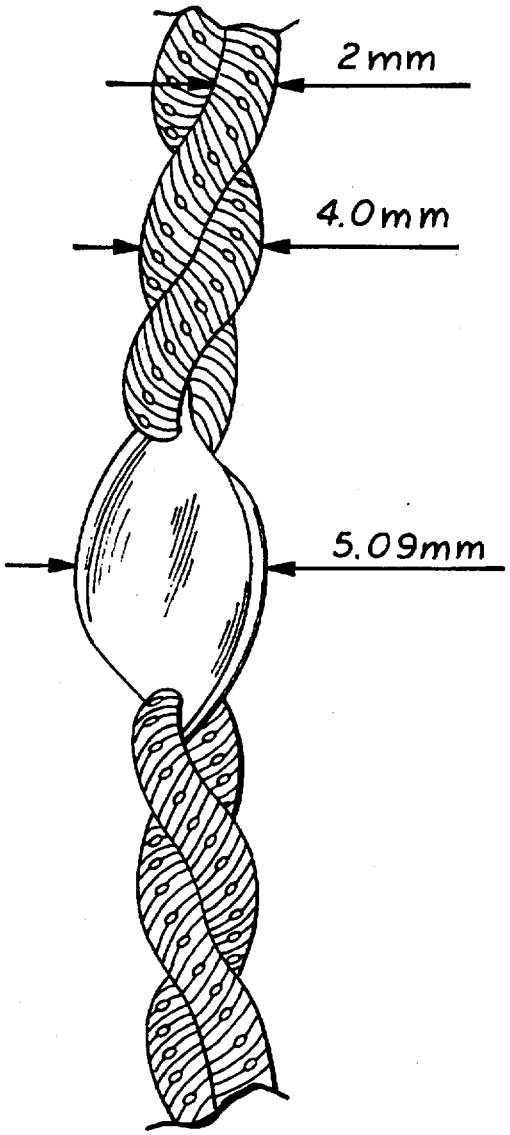
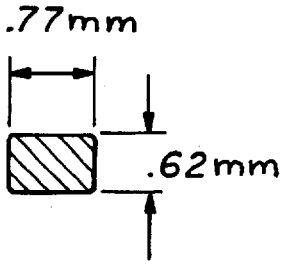
FIG. 25

FIG. 28
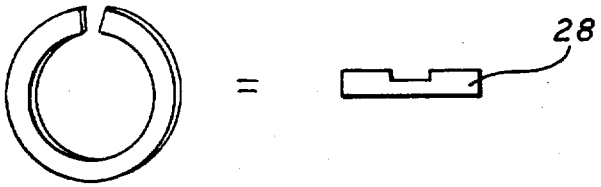
FIG. 29
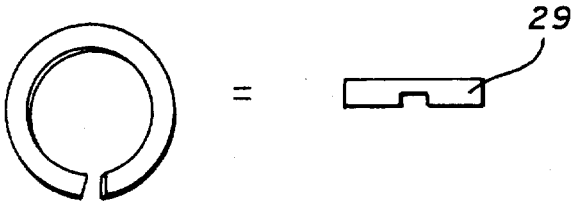
FIG. 30
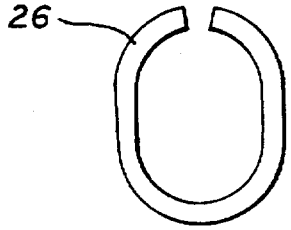
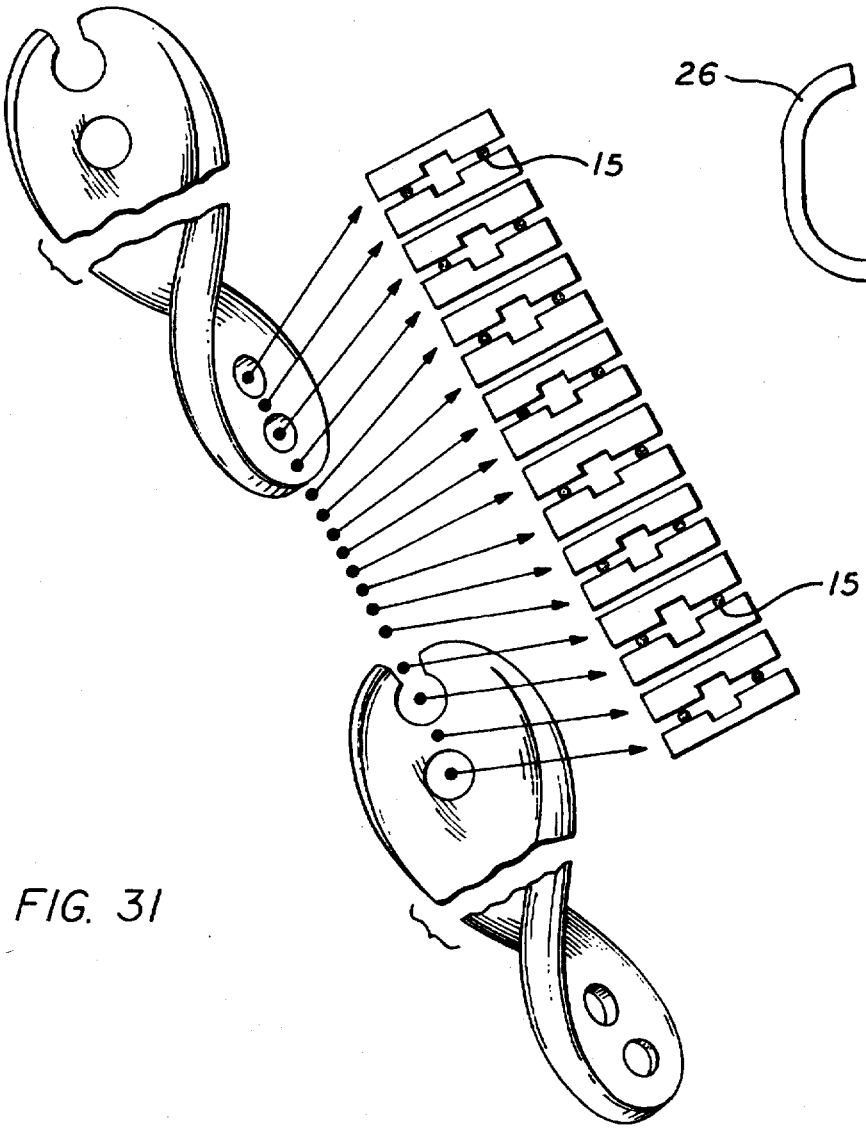
FIG. 31

FIG. 34
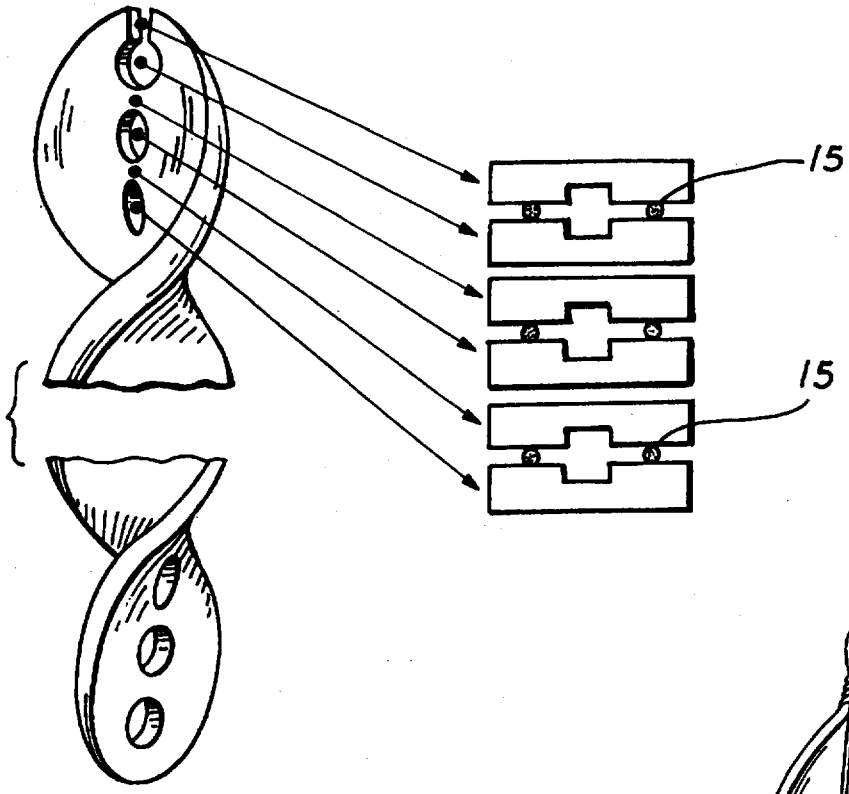
FIG. 35
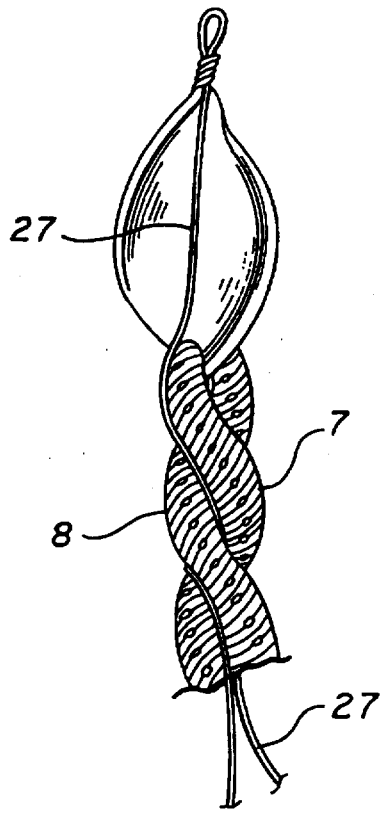
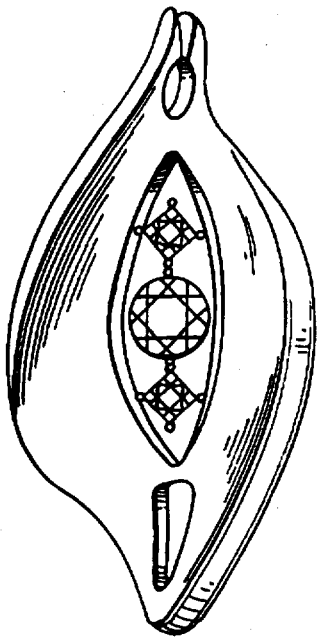
FIG. 36

FIG. 41
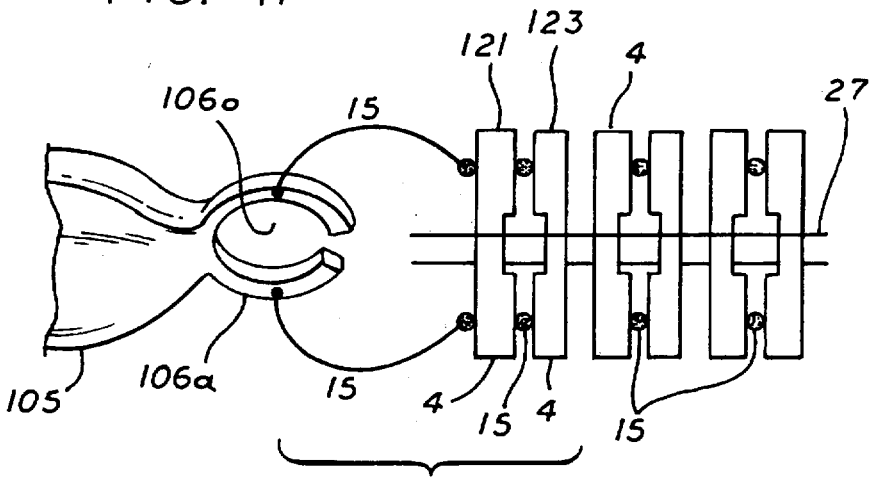
FIG. 42
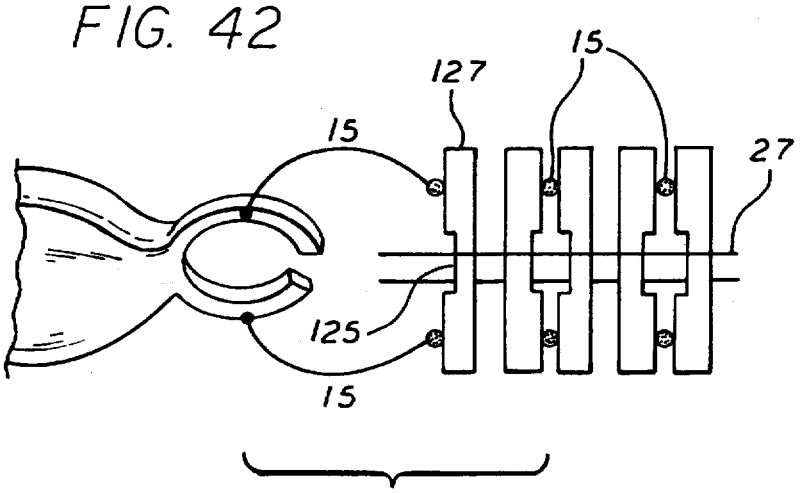
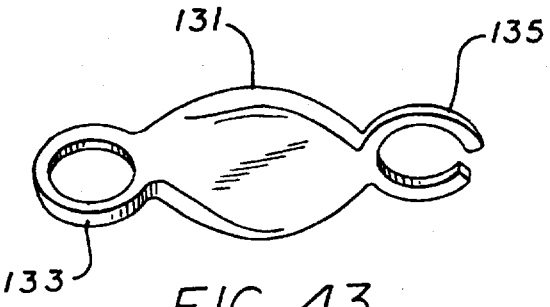
FIG. 43
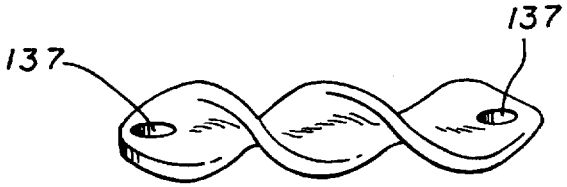
FIG. 44

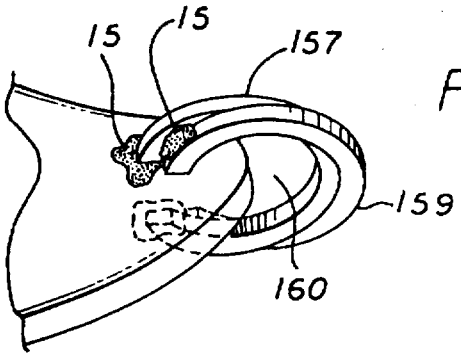
FIG. 58
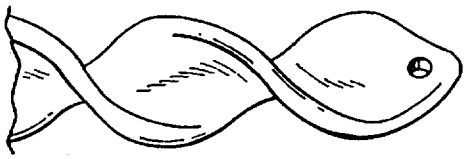
FIG. 59
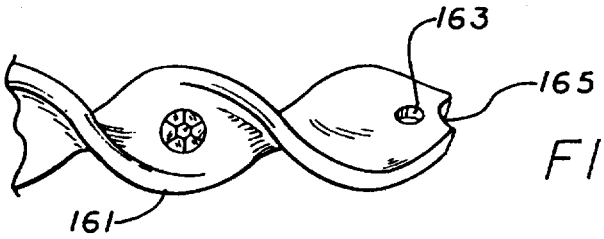
FIG. 60
FIG. 61
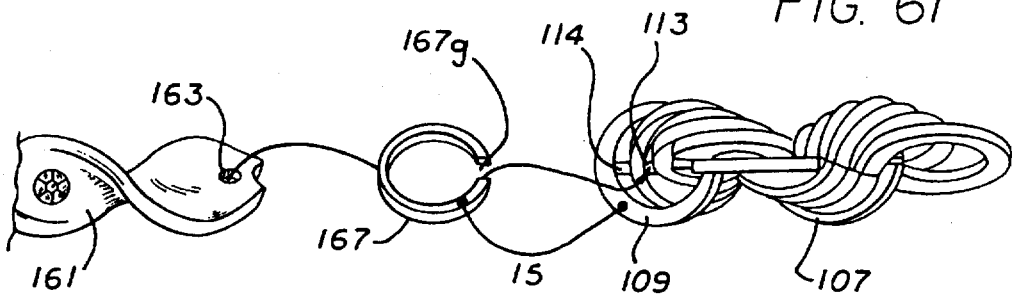
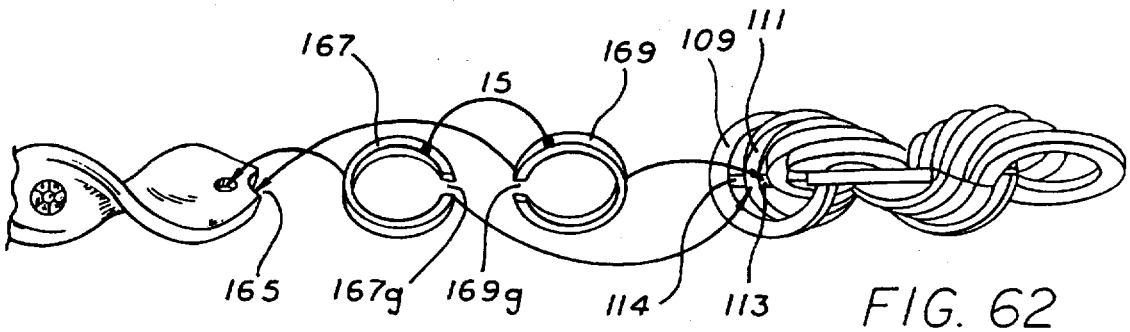
FIG. 62

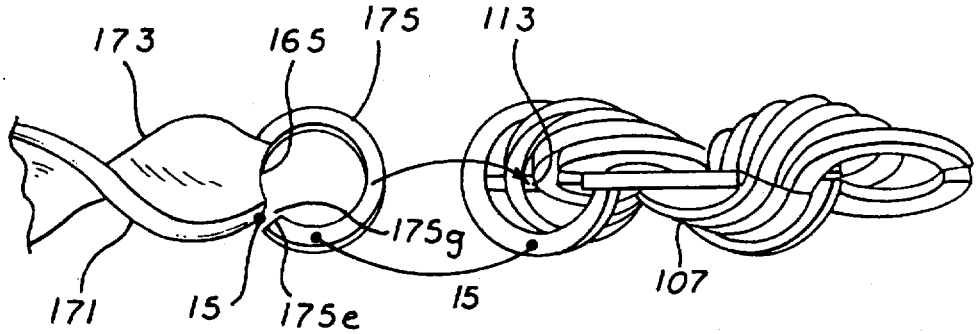
FIG. 63
FIG. 64
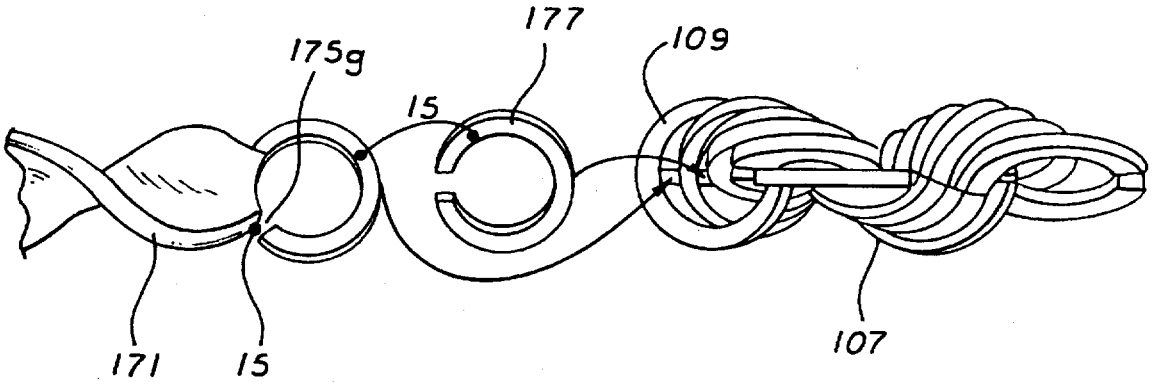
FIG. 65
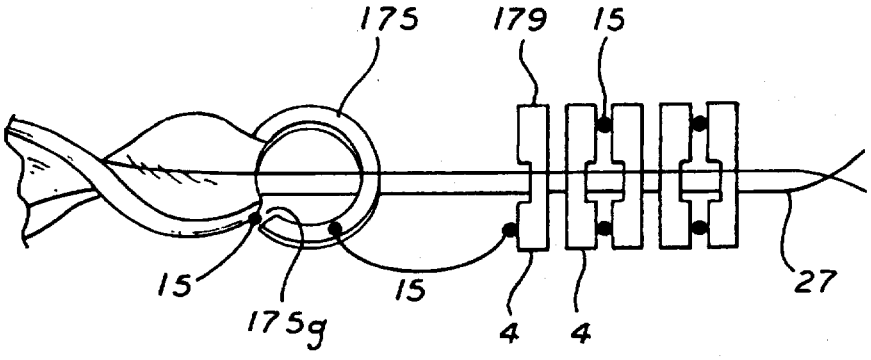

FIG. 68
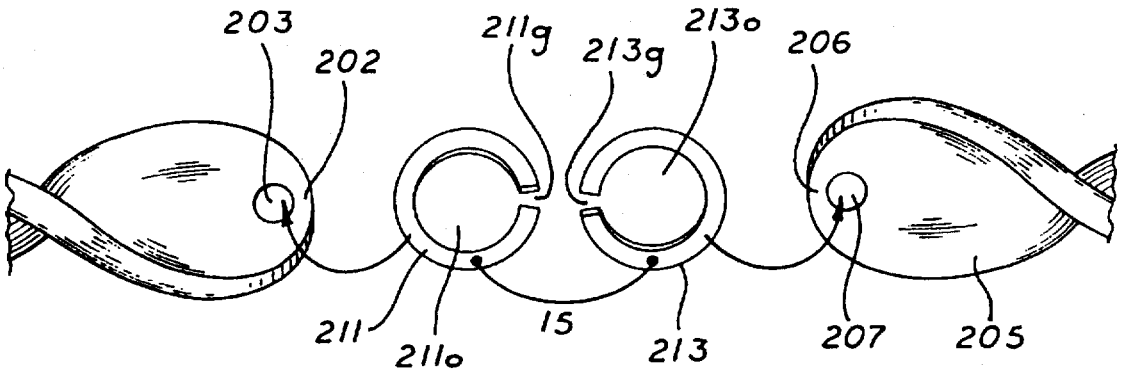
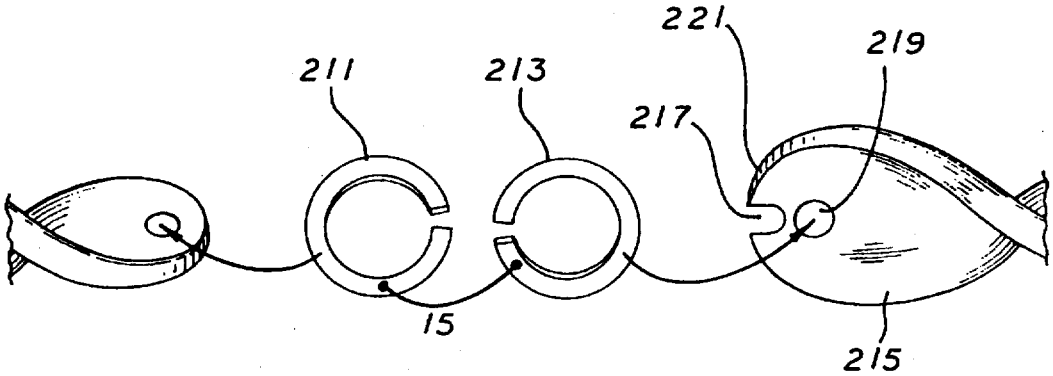
FIG. 69

ROPE CHAIN COMPONENT

CROSS REFERENCE TO RELATED APPLICATION

This application is a Continuation-in-Part of U.S. patent application. Ser. No. 08/224,669, filed Apr. 7, 1994 now U.S. Pat. No. 5,542,244, which is a continuation of U.S. patent application Ser. No. 07/899,742, filed Jun. 17, 1992 (now U.S. Pat. No. 5,301,498, issued on Apr. 12, 1994.

FIELD OF THE INVENTION

This invention pertains to a component to be used as an element in a jewelry rope chain. More particularly, the present invention provides a unitary component having connecting means that promotes the integration of the component with the links of a conventional rope chain by receiving onto the component the individual links of the rope chain in their ordinary sequence, relative position, and orientation as is found on a conventional rope chain. This invention also pertains to various methods of integrating the component with annular links to form a chain or necklace.

BACKGROUND OF THE INVENTION

Jewelry rope chains have been made for many years. Although rope chains can be made by machine, the better quality rope chains are usually manufactured by hand. While a rope chain has the feel of a rope, it is actually made up of a series of individual links made from a precious metal, such as gold, which links are fastened together. The links of hand-made rope chains are made with a tighter fit and are more visually appealing than are machine-made rope chains. A number of annular links are connected and intertwined together in a systematic and repetitive pattern, resulting in an eye-pleasing, flexible and delicate-appearing gold chain that looks like a fine braided spiral of connected segmented portions. In a conventional rope chain, the pattern producing the rope chain is repeated every four links and is herein referred to as the four-link rope chain. In an improvement to the conventional rope chain, it is taught in U.S. Pat. No. 4,651,517 that the links can be constructed in different and narrower dimensions so that the pattern is repeated every six links. By narrowing the cross-section of the link, the six-link rope chain's connected segments appear finer than those of the four-link version and consequently provides a more delicate and refined presentation than that previously known in the prior art of rope chains. By varying the dimensions of the annular link, even finer link arrangement can be obtained. The method of making rope chains is well-known in the art and U.S. Pat. No. 4,651,517, which discloses in detail the making of both four- and six-link rope chains, is hereby incorporated by reference herein.

The conventional four-link rope chain is costly to make. Not only is the precious metal expensive, but the manufacture of the rope chain is labor intensive. The six-link rope chain decreases the amount of precious metal necessary to manufacture a chain of a same length; however, because the links are finer, more labor is required to produce a six-link rope chain than a four-link rope chain of the same length.

SUMMARY OF THE INVENTION

The present invention is a component that is interspersedly connected to rope chain segments and substitutes for a number of links that would otherwise be part and portion of the rope chain. The component is a unitary piece that has means for interlinking with links of a length of a conventional rope chain, whether of the four-link, the six-link, a eight-link or other variety. In its preferred embodiment, the component has a configuration that substantially simulates the spiral shape of a length of rope chain. This spiral shape may be described as being similar to a double helix. Although this spiral shape constitutes a preferred embodiment, the component may take other shapes and configurations.

Because it simulates to some extent the general shape of a length of rope chain, the preferred embodiment, when mounted in a chain that also includes prior art rope chain elements, blends in with said prior art rope chain elements. The advantages of connecting the component with actual rope chain elements are several:

First, the use of the component results in a significant savings in production costs. As indicated above, higher quality rope chains are assembled by hand. The task of interlinking hundreds of annular links to arrive at a bracelet or necklace is a long laborious process that contributes to the relatively high cost of rope chains to the consumer. By substituting the component for various segments of the chain, the number of annular links required to complete a bracelet or necklace can be reduced significantly. Correspondingly, labor costs can be reduced substantially. This results in a reduction of production costs which can translate into savings for the consumer.

Second, a given length of the component is lighter and has less mass than a section of rope chain of the same length. Therefore, the amount of precious metal required to manufacture a necklace or bracelet with the component integrated therein will be less than in the conventional rope chain. By weight, the spiral component weighs 12–15% less than a rope chain segment of the same length. A filigreed version of the component weighs 18–22% less than a rope chain segment of the same length. The result is a reduction in the cost of materials, which may be quite substantial where the material used is gold.

Third, the combination of the component with the conventional rope chain expands the horizons for the creative jewelry designer. The component, while in its preferred embodiment simulating the continuation of the double-helix configuration through the length of the chain, also presents such a designer with opportunities for creating new and different ornamental designs. The component can be a helicoid spiral (as in FIG. 3), an actual double helix (as in FIG. 12), or contain filigreed detail elements (as in FIG. 21). The component can also be of different shapes or colors or a diamond may be set thereon. In fact the component may incorporate any setting, a diamond cut design or any number of other designs. Each one of these, while perpetuating consistency of lines and common design throughout the chain, creates it own distinctive artistic impression.

Fourth, the component, in achieving its cost savings and artistic objectives, does so with minimal compromise to the rope chain's inherent attributes. These attributes are an interesting and delicate design and flexibility. The interesting and delicate design is retained because the component, in its preferred use, is connected with conventional rope chain elements in such a way that the individual links of the rope chain are received on the component in their ordinary sequence and position as occurring on a conventional rope chain. The component itself, as indicated above, integrates in with these actual conventional rope chain elements. Meanwhile, with its conventional rope chain elements, the chain will retain its flexibility.

BRIEF DESCRIPTION OF THE DRAWINGS

In describing the invention, reference will be made to the accompanying drawings wherein:

FIG. 1 is a view of the invention in a position of use wherein it is connected to segments of a conventional rope chain.

FIG. 2 is a view of an annular link of the prior art, a plurality of which are connected and intertwined together to form the conventional rope chain.

FIG. 3 is a front view of the one-half turn spiral component embodiment of the present invention.

FIG. 4 is a view of the one-half turn spiral component from a 90 degree angular displacement to the left.

FIGS. 5 is a cross-sectional view through line 5—5 of FIG. 4.

FIGS. 6–8 illustrate the sequential coupling of annular links with the spiral component's two-hole connection means illustrated in FIG. 3 and with each other during a first repetition of the construction of the conventional four-link rope chain.

FIGS. 9–11 illustrates the sequential coupling of annular links with the spiral component wherein the connecting means is an elongated aperture.

FIG. 12 depicts a second embodiment of the invention, a one-half turn unfilled double helix.

FIG. 16 illustrates a third embodiment of the invention in a position of use, said third embodiment comprised of a full turn filled double helix.

FIG. 17 depicts the full turn filled double helix spiral component without the rope chain portions connected thereto.

FIG. 18 depicts a fourth embodiment of the invention, a full turn unfilled double helix.

FIG. 19 shows the full turn unfilled double helix wherein one of the connection means is an elongated aperture.

FIG. 20 depicts the full turn filled double helix adapted for a six-link configuration rope chain.

FIG. 21 depicts a fifth embodiment of the invention, a filigreed version of the component.

FIG. 22 depicts connection means comprised of an open elongated aperture. The first link is soldered to the component.

FIG. 23 depicts a sixth embodiment of the invention wherein annular link members are integrally provided on each end of the component.

FIG. 24 depicts the conventional annular link with its relevant approximate dimensions.

FIG. 25 is a cross-sectional view of line 24—24 of FIG. 23.

FIG. 26 depicts the preferred embodiment of the invention in a position of use with relevant approximate dimensions.

FIG. 28 depicts an annular link and its schematic equivalent where the gap is in a upward orientation.

FIG. 29 depicts an annular link and its schematic equivalent where the gap is in an orientation that is opposite that depicted in FIG. 28.

FIG. 30 depicts an elongated link that is adapted for three, four and five hole connection means on components.

FIG. 31 is an illustrative schematic representation of the annular links as they are orientated with respect to the component and to each other in the practice of this invention in the four-link repetition variety.

FIG. 34 is an illustrative schematic representation of the annular links as they are oriented with respect to a "filled" component and to each other in the practice of this invention in the six-link repetition variety.

FIG. 35 illustrates the use of a wire to keep annular links in place until solder can be applied.

FIG. 36 illustrates an embodiment of the invention wherein the body has a precious stone set thereon.

FIG. 41 is a schematic representation of the invention whereby individual annular links, with their gap orientation indicated, are interlinked with the component, held in place with a working wire, and then soldered.

FIG. 42 is a schematic representation of another manner of interlinking individual annular links with the component, holding the chain together with a working wire, and soldering the piece together.

FIG. 43 is a view of an embodiment of the invention wherein annular link members are integrally provided on each end of the component but wherein an annular link member one end of the component is "closed".

FIG. 44 is a view of a full turn spiral component embodiment of the present invention having an elongated connecting means at each end.

FIG. 58 is a closer view of the "off-set" annular links of FIG. 57 and their soldering arrangement.

FIG. 59 is a sectional view of a component having one aperture comprising as connecting means.

FIG. 60 illustrates a sectional view of a component having one aperture and a truncated end (or notch) as connecting means. It also'shows a precious stone disposed on the component body.

FIG. 61 shows the connecting of the component of FIG. 60 and a finished rope chain segment with a single connecting annular link.

FIG. 62 shows the connecting of the component of FIG. 60 and a finished rope chain segment with two connecting annular links.

FIG. 63 shows a further embodiment of the component wherein a component is truncated and has an annular link integrally formed thereon but where one end of the annular does not adjoin the component body. This component is connected to a finished rope chain segment by inserting the open annular link into the finished rope chain segment and then soldering the end to the component body.

FIG. 64 is a view of the embodiment of FIG. 63 as it is attached to a finished rope chain with a connecting annular link placed therebetween.

FIG. 65 is a schematic representation of the fashioning of a chain with the component of FIG. 63 and interlinking it with individual annular links, holding the chain together during manufacture with a working wire, and applying solder thereafter.

FIG. 68 shows the fashioning of a chain by using only two annular links between two components.

FIG. 69 shows the fashioning of a rope chain by using only two annular links between two components where one of the components has a notch at an end to accommodate the periphery of an annular link and an inner aperture to receive another annular link.

DETAILED DESCRIPTION

Figure 13:
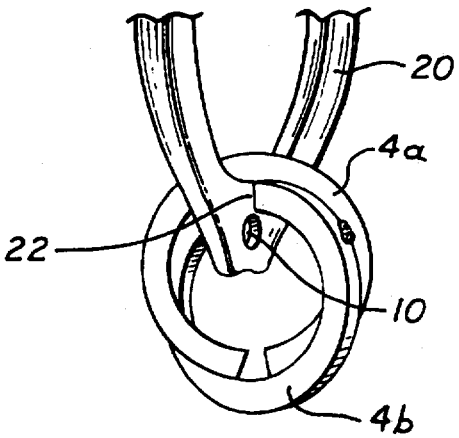
FIGS. 13 and 14 illustrate the sequential coupling of annular links with the one-half turn unfilled double helix of FIG. 12.

Referring now to the drawings, there is illustrated in FIG. 1 a view of the preferred embodiment of the rope chain component 1 in a position of use, connected with conventional rope chain segments 2. The conventional rope chain segments 2 pictured here are of the four-link repetitive variety. The component can be modified to adapt to the six-link type or eight-link type as well as other variations. The conventional rope chain segments 2 are made with a systematic and repetitive interlinking of a basic annular link 4 that has a gap 5 therein. The annular link 4 must meet certain dimensional requirements for the interlinking to result in a well-fitting rope chain. Such dimensions are known in the art and will vary from four-link variety to six-link variety to eight-link variety. The annular link 4 and the gap 5 thereon is depicted in FIG. 2.

FIG. 3 illustrates an embodiment 6 of the component 1 that substitutes for a length of rope chain that represents a one-half or 180 degree revolution of a "filled" double helix. This embodiment 6 is hereinafter referred to as the "one-half turn spiral component". It should be noted here that the conventional rope chain is not truly composed of a double helix but merely provides the appearance of a double helix. As can best be viewed in FIG. 1, the inter-twined links in the conventional rope chain segment 2 produces the appearance of a first braid 7 and a second braid 8, the combination of which results in a double heloidical appearance.

FIG. 4 is a view of the one-half turn spiral component 6 from a 90 degree angular displacement to the left, compared to FIG. 3.

Returning to FIG. 3, the one-half turn spiral component 6 is helicoid in shape with its opposite edges spiraling in opposition and providing the appearance of a double helix. The term "filled" is used because a true double helix is comprised of two helicoid lines encircling each other. Here, the component gives the appearance of a double helix but the space between the two helicoid lines is filled. The one-half turn spiral component 6 also has means for connection 9 with conventional rope chain segments. In this particular case, on one end of component 6, such connection means 9 are comprised of aperture 10 and open-aperture 11. Open aperture 11 has an opening 12 and the space between aperture 10 and open aperture 11 comprises a nexus 13. On the other end of component 6, connection means 9 are comprised of an elongated aperture 14 and a notch 3. Each of the apertures may have a scalloped portion 16 which permits an associated annular link 4 to rest in a determined position.

As will be seen, these connection means 9 can be varied in their arrangement and this particular combination is described herein for illustrative purposes only. In general terms however, the connection means 9 permit the receiving of a plurality of annular links 4 of a rope chain to be received onto and connected to the rope chain component 1 in their ordinary sequence and position as they occur on a rope chain segment. In a conventional rope chain, an annular link located on the chain has substantially the same general orientation as the seventeenth annular link further down the chain. In approximate terms, each link on the chain has an angular displacement of 22.5 degrees when compared with the links immediately adjacent thereto, i.e. 360°/16 links= 22.5 degree per link. The connection means 9 takes this angular differential into consideration so that each link may be received onto the component 1 in their mutual and ordinary orientation on the rope chain.

As an illustration, reference is made to FIG. 5 which is a cross-sectional view through line 5—5 of FIG. 4. The axis $A_1$ through aperture 10 is at an approximate angle of 45° from the axis $A_2$ of open aperture 11. This permits, as will be seen, the respective annular links through aperture 10 and open aperture 11 to be properly positioned with respect to each other and with respect to the annular link that resides between those two. Alternatively, the apertures may be given a large enough diameter to permit the annular links within to rest in a broader range of angles. This is less preferred as the annular links would be in a less fitting relationship with the component.

FIGS. 6–8 illustrates the manner of coupling an end of the one-half turn spiral component 6 of FIG. 3 to a conventional four-link rope chain segment 2. As portrayed in FIG. 6, a first annular link 4*a* is inserted into aperture 10. Gap 5*a* of first annular link 4*a* is placed substantially opposite the portion of the link that lies in aperture 10. Described in different terms, the gap 5*a* is about 180 degrees displaced from that portion of the link that lies within aperture 10.

A second link 4*b* is then added as shown in FIG. 7. Second annular link 4*b* is inter-linked with annular link 4*a* by inserting, via gap 5*b*, second annular link 4*b* over link 4*a*. Gap 5*b* rests over nexus 13, that portion of the component 6 that lies between aperture 10 and open aperture 11. The distance between aperture 10 and open aperture 11 (signified by "d"), otherwise known as the width of nexus 13, should provide enough room for second annular link 4*b* to rest.

FIG. 8 shows the affixation of the third annular link 4*c* and fourth annular link 4*d* to complete the first repetition. Third annular link 4*c* is inserted through first annular link 4*a*, second annular link 4*b* and through open aperture 11 via gap 5*c*. Third annular link 4*c* is then circumferentially rotated until gap 5*c* lies opposite that portion of third annular link 4*c* that sits within open aperture 11. Fourth annular link 4*d* is then inserted over annular links 4*a*–4*c* via gap 5*d* and gap 5*d* is brought to confront opening 12. This completes the first repetition.

As taught in the prior art, first annular link 4*a* is attached to second annular link 4*b* by solder 15, best viewed in FIG. 8. Third annular link 4*c* is attached to fourth annular link 4*d* in like manner. The bonding between each of these two pairs of annular links insures that the rope chain will not unravel into its constituent elements. At the same time, the first and second annular links, 4*a* and 4*b*, are not bonded to the third and fourth annular links, 4*c* and 4*d*. It is this relative freedom of movement between each of these linked pairs that provides the rope chain with its flexibility.

For purposes of clearly illustrating the intertwining of the annular links, 4*a*–4*d*, with the spiral component 6 and each other, the links are not necessarily rendered in FIGS. 6–8 in their actual orientation. For example, in FIG. 1, first annular link 4*a* appears as if its circumference is normal to the surface of spiral component 6. In actuality, as illustrated in FIG. 8, first annular link 4*a* is rotated so that its surface 17 (hidden from view by its opposite side) is brought into close proximity to the surface 18 of spiral component 6 and into the space created by scallop 16. Scallop 16, hidden from view by first annular link 4*a* in FIG. 8, provides the associated annular link 4 with room for movement and a position of rest and therefore adds to the flexibility of the chain. Each subsequent added annular link 4 is similarly rotated. FIG. 1 provides a more accurate rendition of the layering of the various annular links 4.

After completion of the first repetition, a second repetition is started by inserting a fifth annular link over annular links 4*b*–4*d*. The fifth annular link is threaded between gap 5*a* of first annular link 4*a*. This fifth annular link is then circumferentially rotated until its gap lies substantially opposite that portion of link located within gap 5*a*. The second, third and fourth links of this second repetition are then added as described above in the case of the first repetition. The continued extension of the rope chain by adding annular links 4 is conventionally known as described in U.S. Pat. No. 4,651,517. This process continues until the desired length is obtained for the conventional rope chain segment.

As the rope chain is made longer and longer with the addition of annular links 4, the opportunity for unraveling of the annular links 4 increases. To continuously apply solder to every two annular links 4 as those two links are added would be interruptive of the interlinking process and be cost-ineffective. One manner of maintaining the rope chain and preventing the unraveling until a more feasible time when solder 15 could be applied, is to wind a wire 27 over one end of a rope chain (or component), double up the wire and wrap it along both opposite sides of the rope chain between braids 7 and 8 as the rope chain is extended by the addition of annular links 4. This is illustrated in FIG. 35. The buttressing effect of the wire will hold the annular links 4 in place until solder can later be added.

It should be restated that the above description is in the context of a four-link rope chain. By modifying the connection means, the spiral component 1 can be adapted to couple with a six-link rope chain or another variation thereof.

FIGS. 9–11 depict the coupling of conventional rope chain annular links 4 with the other end of the one-half turn spiral component 9 depicted in FIG. 3. As can be seen, connection means 9 on this end of component 9 differs from the previously described connection means 9. Here, the connection means 9 is comprised of an elongated aperture 14. A notch 3 may be disposed at the end of the component 6 to provide freedom of movement for an adjacent annular link 4. The notch 3 may or may not be necessary depending on the width of lobe 19.

As portrayed in FIG. 9, a first annular link 4a is inserted into elongated aperture 14. First annular link 4a is placed so that it abuts to that portion of the aperture that is closest to the center of the component 6 and furthest from notch 3. Gap 5a of first annular link 4a is placed substantially opposite the portion of the link that lies in elongated aperture 14.

FIG. 10 shows the addition of a second annular link 4b. Second annular link 4b is inter-linked with annular link 4a by inserting, via gap 5b, second annular link 4b over first annular link 4a. Gap 5b preferably, but not necessarily, may rest within elongated aperture 14. Elongated aperture 14 should have a length so that three annular links 4, in their ordinary and relative positions on the rope chain, may fit therewithin.

FIG. 11 shows the affixation of the third annular link 4c and fourth annular link 4d to complete the first repetition of the rope chain on this end of the 4-link rope chain. Third annular link 4c is inserted through first annular link 4a, second annular link 4b and through open aperture 11 via gap 5c. Third annular link 4c is then circumferentially rotated until gap 5c lies opposite that portion of third annular link 4c that sits within elongated aperture 14. Fourth annular link 4d is then inserted over annular links 4a–4c via gap 5d and gap 5d is brought to abut to lobe 19. Lobe 19, that portion between the elongated aperture and the end of component 6 is approximately the length of the cross-sectional width of annular link 4. This completes the one repetition.

As taught in the prior art and described above, first annular link 4a is bonded to second annular link 4b by solder 15, best viewed in FIG. 11. Third annular link 4c is attached to fourth annular link 4d in like manner. The bonding between each of these two pairs of annular links insures that the rope chain will not unravel into its constituent elements. So that the chain will remain flexible, second annular link 4b is not bonded to adjacent third annular link 4c. Similarly, fourth annular link 4d is not attached to the adjacent first link of the next repetition.

Either of the two connecting means 9 described above, or any of the connecting means hereinafter described may be used to connect a rope chain segment 2 with the component 9 as they each operate on the same principle: They promotes the integration of the component with the links of a conventional rope chain by receiving onto the component the individual links of the rope chain in their ordinary sequence, relative position and orientation as is found on a conventional rope chain.

Figure 14:
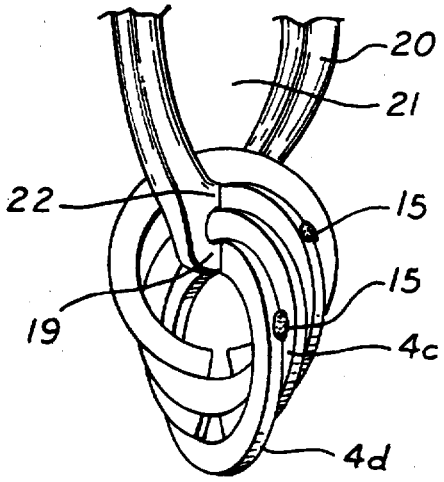

FIG. 12 depicts another embodiment of the invention, a one-half turn unfilled double helix 20. This embodiment 20 is termed "unfilled" because it is a substantial replica of a double helix having two helices, each spiraling around the other with an interstice therebetween. Unlike the embodiments described above, the space between the helices is not filled but instead comprises the spatial opening 21. The spatial opening 21 serves as an aperture for coupling with a rope chain segment 2. As shown in FIG. 13, the first annular link 4a in a repetition is inserted through the one-half turn unfilled double helix 20 via gap 5a so that the annular link 4a abuts against bridge 22, the portion between the spatial opening 21 and aperture 10. Annular link 4a is rotated until gap 5a is directed away from aperture 10. Annular link 4b is then coupled with annular link 4a and unfilled double helix 20 via gap 5b. Gap 5b is placed so that it abuts bridge 22. Referring to FIG. 14, gap 5c of third annular link 4c is then threaded through first and second annular links 4a and 4b and unfilled double helix 20. As in the previous examples, gap 5c of annular link 4c is directed away from aperture 10. Finally, fourth annular link 4d is coupled with annular links 4a–4c and unfilled double helix 20 via gap 5d. Gap 5d is brought to abut to lobe 19. This completes the first repetition. Solder 15 is applied in the manner previously described above.

Various designs can also be mounted on the spatial opening. For example, precious stones, initials, or plates bearing different aesthetic figures can be mounted on the component over the spatial opening. A message, such as "I Love Mom", can be placed either on the spatial opening or, if there is no opening, on the body of the component.

Figure 15:
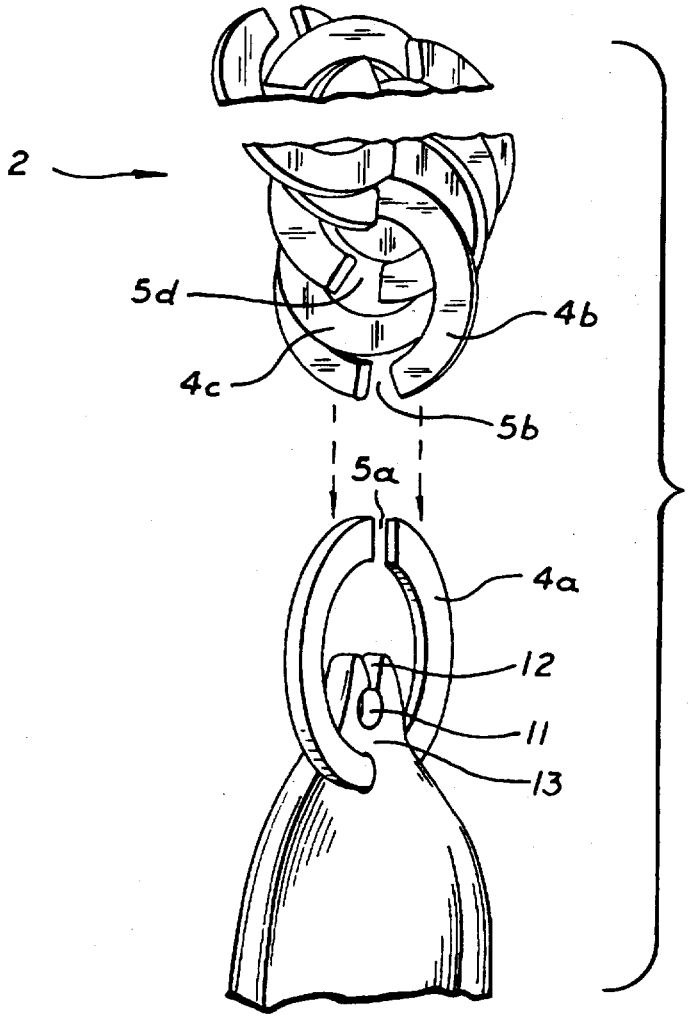
FIG. 15 illustrates a method of connecting the invention with the annular links of a rope chain whereby the rope chain is preformed before being received into the spiral component.

Heretofore we have described one manner of attaching rope chain links to the rope chain component 1 consisting of first attaching a first link to the component 1 and then sequentially weaving in a second, third and fourth link and etc. Another means of achieving this same result is now described as follows. For illustrative purposes, take the case of a four-link rope chain. Preform a length of rope chain according to known conventional methods by taking a first annular link 4a and interlinking to it a second annular link 4b and thereafter attaching to the evolving rope chain a third annular link 4c and a fourth annular link 4d. The process is repeated by linking another first annular link 4a after fourth annular link 4d to begin the next repetition and continues until the desired length of rope chain is obtained. At the extremity, the first annular link 4a is removed to expose second annular link 4b as the end link. As can be seen in FIG. 15, second annular link 4b has gap 5b displaced away from the length of rope chain segment 2. An annular link is then inserted into aperture 10 of component 1 with gap 5a displaced away from the component. This annular link comprises the first annular link 4a of a repetition. The length of rope chain with second annular link 4b as its first link is then brought to the component and the two parts are integrated by inserting gap 5a first through annular link 4b or gap 5b, through a portion of annular link 4c and then through gap 5d. Likewise, gap 5b of annular link 4b is brought through annular link 4a or gap 5a, through opening 12 and open aperture 11 until it comes to rest at nexus 13. A portion of annular link 4c is also brought through gap 5a, opening 12 until it sets within open aperture 11. Gap 5d is brought through gap 5a and sits adjacent to opening 12. By fitting the various links together in the above manner and soldering them as previous described, the outcome is the same as the process described earlier, that is, where a repetition of annular links 4 are mated initially to a component before subsequent repetitions are mated to the growing chain.

The component can be made in different lengths. FIGS. 16–17 depicts a third embodiment of the component. Here the component is a full turn filled double helix. FIG. 17 illustrates the individual component while FIG. 16 shows the component in a position of use. By lengthening the spiral component, additional savings of labor and material costs can be realized. However, the resulting bracelet or necklace will be less flexible because the actual rope chain segments will be proportionately lessened.

FIGS. 18 and 19 illustrate a full turn unfilled double helix structure. In FIG. 18, the connection means at the pictured lower end is comprised of two closed apertures while in FIG. 19, the connection means at the pictured lower end is comprised of an elongated aperture 14. In both cases, a four-link or six-link variety of rope chain may be used. If a six-link variety of rope chain is to be used, the spatial opening 21 is used to receive the first link of the six link repetition.

FIG. 20 depicts another embodiment of the component with connection means 9 for a six-link rope chain configuration.

The integration of a rope chain segment of the six link variety with the rope chain component adapted for the six link rope chain, is accomplished in like manner to the four-link counterpart. As taught by U.S. Pat. No. 4,651,517, in the six link configuration, the dimensions of each link must be modified to adjust for the additional two links to complete a repetition. When applied to the rope chain component, the six-link annular link must be altered to accommodate the additional length of the rope chain component required by the addition of a third aperture or its equivalent. The altered or "six-link" annular link 26 is depicted in FIG. 30.

The above-described manner of "sliding-in" a preformed segment of rope chain to mate with a component 1 and an annular link pre-positioned on the component 1, can be extended to the six-link variety and other varieties of rope chain. In the case of the six-link variety, this may be accomplished in one of two ways. In the first alternative, three annular links 26, comprising the first, second and third annular links of a six-link rope chain segment are first attached to and pre-positioned on the component 1, through third aperture 32, at nexus 13 and through second aperture 31, before the six-link rope chain segment (with the appropriate fourth annular link leading the way) is "slid" onto the component 1 for mating with the component and the three pre-positioned annular links. For the rope chain segment to "slide" into the component 1, the connecting means 9 at the extremity comprises opening 12. After the rope chain segment is "slid" into the rope chain component 1, the application of solder 15 to bond the annular links as described above will prevent the rope chain segment from unraveling. In a second and preferred alternative, a bifurcation 33 is placed between the first aperture 30 and the second aperture 31. The bifurcation 33 is illustrated in FIG. 20 and indicated by the dotted lines. In this way, only one annular link 26 need be prepositioned on the component 1, at third aperture 32, as the other annular links to be connected with the component can be "slid" through the opening 12 and the bifurcation 33 to be attached to the prepositioned annular link. Again, solder 15 is applied to the annular links as described previously to prevent the unraveling of the rope chain.

FIG. 21 depicts an embodiment of the component that contains filigreed feature 23. FIG. 22 depicts connection means comprised of an open elongated aperture 24. Depending upon the length of the aperture, it may accommodate two or more annular links. The first link is soldered to the component as shown at 15. The open elongated aperture 24 receives a plurality of annular links 4 of a rope chain segment 2 onto the component 6 in their ordinary sequence and orientation. Therefore the open elongated aperture 24 is preferably formed so that this would be possible. One manner of facilitating the acceptance of the annular links 4 within the elongated aperture in their ordinary sequence and angular orientation would be to form the elongated aperture 24 in a "twisting" manner so that the location where a first annular link rests will have a 22.5 degree angular differential relative to the location where the next annular is to rest. However, the same result may be obtained by forming the elongated aperture with a width that would provide enough space to tolerate the varying angular orientations. The use of the open elongated aperture 24 in this above-described manner is a quick means of connecting a rope chain segment 2 with the component. However, because the rope chain segment 2 is secured to the component 6 only by solder 15 and there is no other structural support, the connection means is not as strong as the other methods described herein.

FIG. 23 illustrates a sixth embodiment of the component where annular link members 25 are integrally formed on each end of the component. These annular link members 25 comprise the first links of a repetition. Additional links are then attached (and soldered where required) as taught in the prior art.

FIGS. 24 to 27 provide suggested dimensions for one aspect of the practice of this invention. It cannot be stressed too strongly that these dimensions are illustrative only and not limiting.

FIG. 24 depicts the conventional annular link. The outer diameter of the annular link $D_o$, i.e. the diameter from periphery to periphery, is approximately 4.08 mm. The inner diameter $D_i$ is approximately 2.55 mm. At the gap 5, the opening at the outer periphery is about 1 mm and narrows to 0.89 mm at the inner periphery. The cross-sectional width and thickness are 0.77 mm and 0.62 mm respectively.

Figure 27:
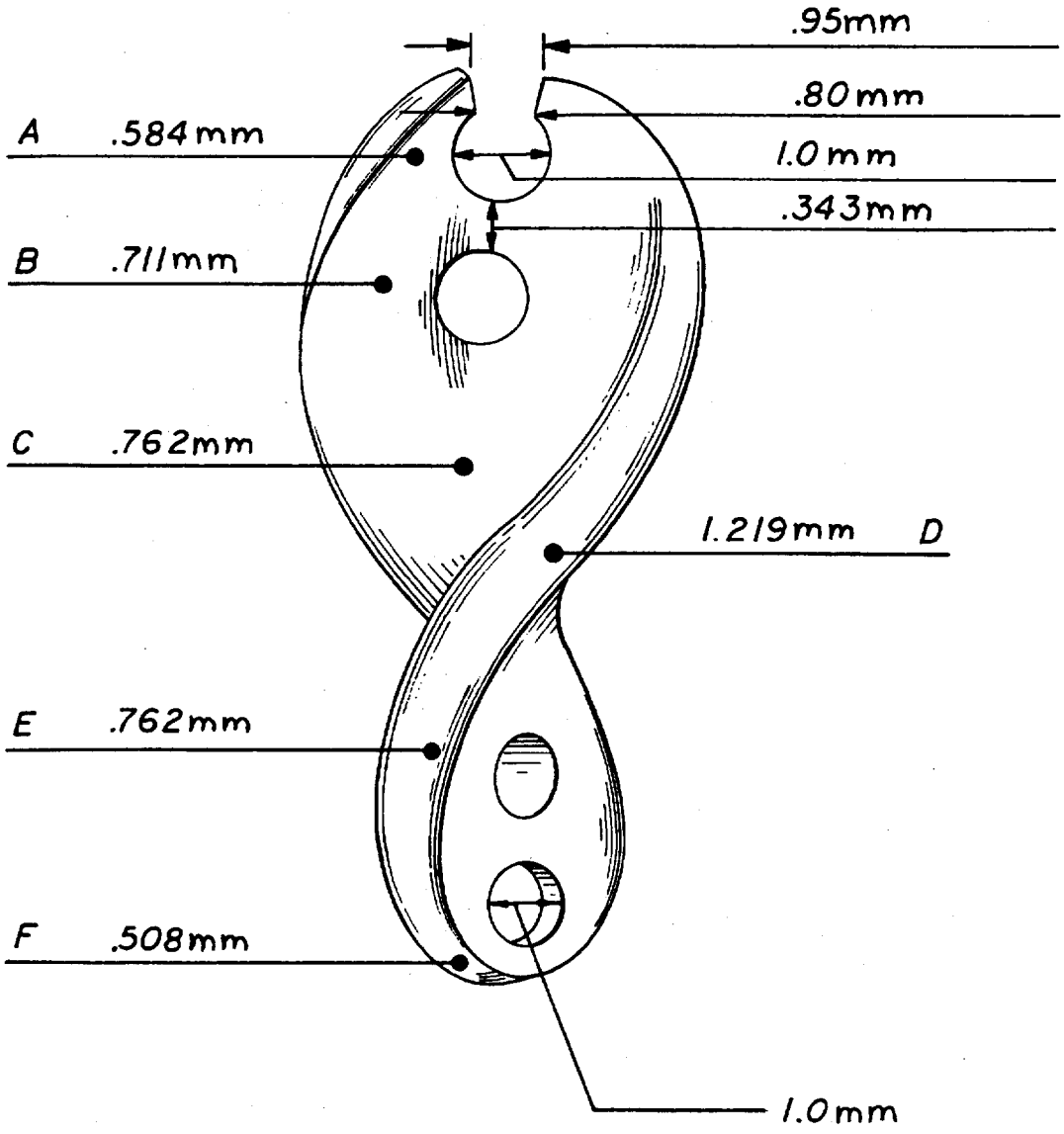
FIG. 27 depicts the one-half turn rope chain component with relevant dimensions.

Referring to FIG. 27, the suggested dimensions of the preferred embodiment are as follows: At the outer portion of the gap, the opening is about 0.95 mm. The gap is 0.8 mm at the point it abuts the open aperture 11. The open aperture 11 and aperture 10 are each 1 mm in diameter. The aperture 10 and open aperture 11 are spaced approximately 0.34 mm from each other. At the other end, the two apertures 10, 10 each have diameters of about 1 mm. The aperture 10 closest to the end is about 0.3 mm removed therefrom in the described embodiment. There may be some variance in this distance. A distance greater than 0.3 mm would provide more structural support for the associated annular link contained therein but may result in less flexibility between the rope chain segment and rope chain component.

The thickness of the spiral component at various points as indicated in FIG. 27, is noted in the following table:

| Location | Thickness (mm) |
|---|---|
| A | .584 |
| B | .711 |
| C | .762 |
| D | 1.219 |
| E | .762 |
| F | .508 |

From edge to edge, the spiral component is about 5.09 mm wide while from end to end it is approximately 10 mm in length.

Referring to FIG. 26 with regard to the rope chain itself, the width of the double helix is 4 mm while the diameter of each helicoidal strand 7,8 is approximately 2 mm. The elements of FIG. 26 are not shown to scale in order to more clearly illustrate the relative dimensions thereof.

Where the connecting means comprise three or more apertures or the equivalent of three or more apertures on a component, the annular link must be modified and elongated to accommodate the length of component that the annular link must encompass. FIG. 30 depicts an elongated annular link 26 that is used wherein the connection means comprises or is equivalent to three apertures.

FIGS. 28 and 29 illustrates the annular link and its schematic equivalent. Schematic equivalent 28 represents an annular link wherein the gap 5 is directed in the indicated direction. Schematic equivalent 29 represents an annular link wherein the gap 5 is directed in the opposite direction. The schematized gap 5' in the equivalents depict the direction which the actual gap 5 takes. FIG. 31 schematically depicts the orientation of the annular links with respect to each other and with respect to the components 6*a* and 6*b* which are connected by the rope chain segment. The schematic representation also indicates the connection of the individual links by solder 15.

Figure 32:
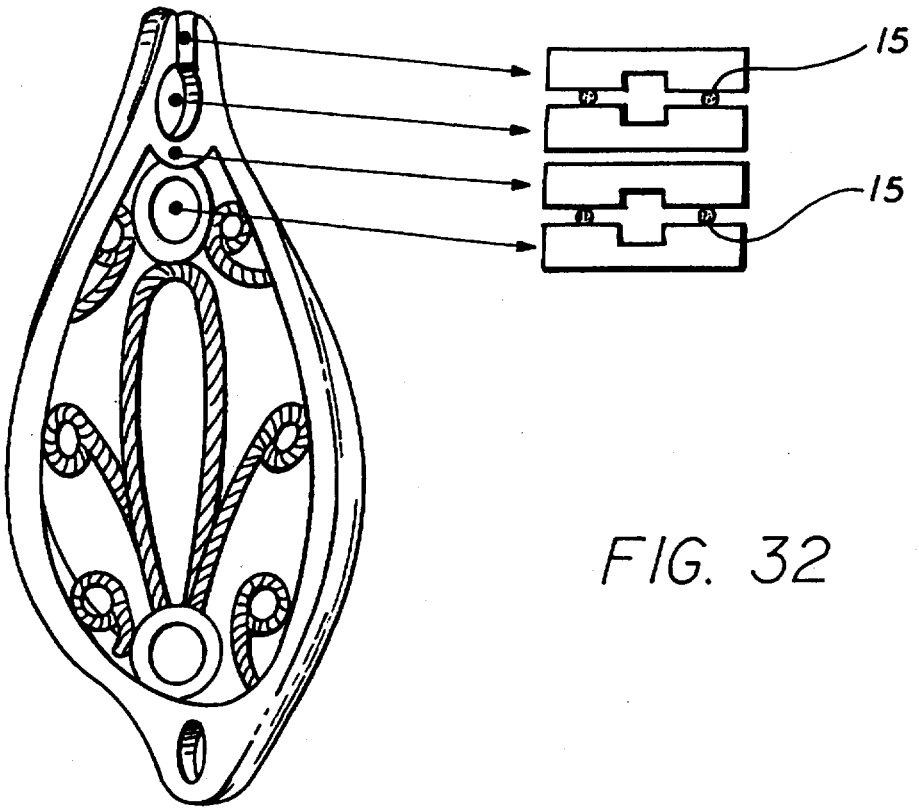
FIG. 32 is an illustrative schematic representation of the annular links as they are oriented with respect to the component and to each other in the practice of this invention in the four-link repetition variety where the component is filigreed.
Figure 33:
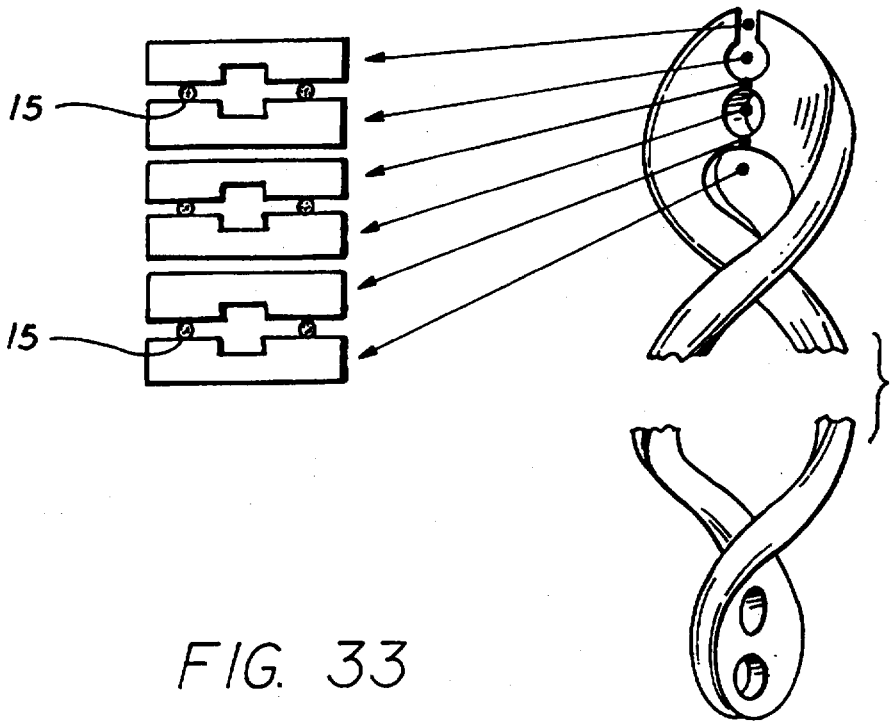
FIG. 33 is an illustrative schematic representation of the annular links as they are orientated with respect to a double helix component and to each other in the practice of this invention in the six-link repetition variety.

FIGS. 32, 33 and 34 schematically depicts the integration of the annular links 4 with the filigreed component, the six-link double helix spiral component and the six-link "filled" spiral component respectively, so that those skilled in the art will appreciate the preferred orientation of gaps 5 in the links 4. Pairs of links 4 are soldered, as shown at 15.

Figure 37:
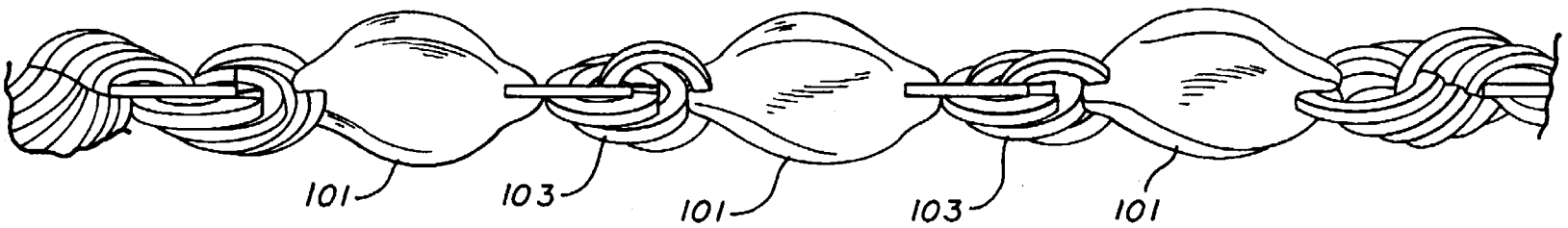
FIG. 37 illustrates a chain segment comprised of a plurality of rope chain components, each component connected to an adjacent component by rope chain segments.

An important aspect of the present invention is the ability to combine ease of manufacture and lower manufacturing costs with aesthetic beauty. By connecting a series of spiral rope chain components 101 with short lengths of rope chain segments 103, manufacturing costs can be kept to a minimum. FIG. 37 illustrates a length of chain comprised of a plurality of rope chain components 101, each component 101 being connected to an adjacent component 101 by a short rope chain segments 103. This combination of rope chain segments 103 with rope chain components 101 not only maintains the unique aesthetic presentation of the rope chain, but provides additional opportunities for creative design. While the rope chain component need not be spiral-shaped, the spiral shape is the preferred embodiment because it continues the helical tendencies of the rope chain.

The invention may be practiced in a number of ways that lessens the time and costs of manufacture. These methods of manufacture fall into two general categories: The first type involves the preforming of rope chain segments (by interlinking annular links and soldering them as described above) that are then connected to rope chain components. The second involves the fashioning of a chain by connecting individual annular links and rope chain components together and then soldering them only after a length of chain has been fashioned. In each case, the use of a "working wire" helps keep the chain intact until final finishing. The working wire is wrapped along the "grooves" formed on opposite sides of the double helix-like form of the chain.

Figure 38:
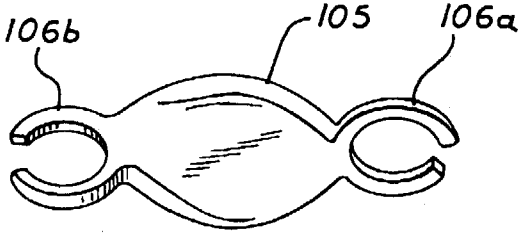
FIG. 38 depicts a further embodiment of the invention wherein annular link members are integrally provided on each end of the component.

FIG. 38 depicts a component 105 wherein annular link members (or annular link formations) 106*a* and 106*b* are integrally provided on each end of the component. This component 105 has a one-half turn (180 degree) spiral but it can also be formed into a full-turn (360 degree) spiral or some other configuration.

Figure 39:
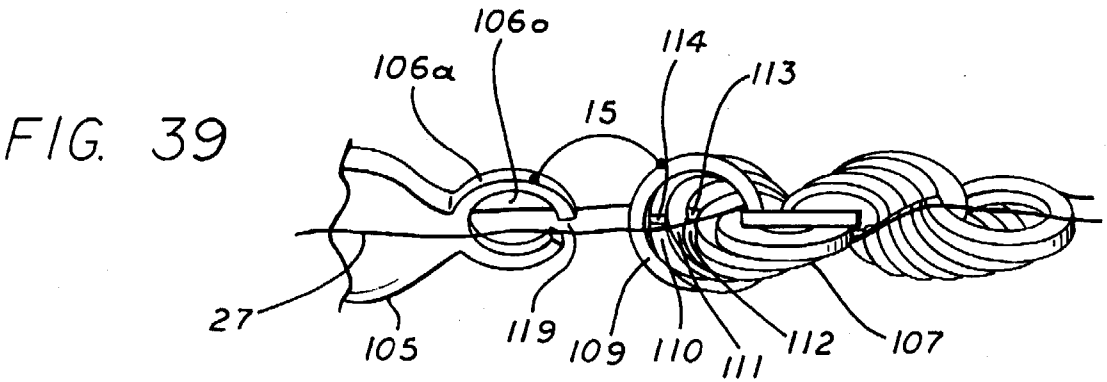
FIG. 39 depicts a method of connecting the invention with a preformed (or prefinished) rope chain segment, the rope chain segment held together by a working wire.

FIG. 39 shows the component 105 brought in proximity to a preformed (or prefinished) rope chain segment 107. The annular links of the preformed rope chain segment are preferably soldered together in twos as described above so that the rope chain segment 107 will not come unraveled. The annular link on each end of the rope chain segment 107 is referred to as the "terminal" annular link. The terminal annular link is preferably arranged in a closed position, i.e., the gap of the terminal annular link preferably faces away from the end of the segment. First and second openings 113 and 114 in the rope chain segment 107 are respectively provided by the gaps in the fourth annular link 112 from the end and the second annular link 110 from the end. A working wire 27 is also illustrated in FIG. 39. In practice, the working wire 27 is generally not applied until after the rope chain segment 107 is positioned firmly in place with respect to the component 105. The gap 119 of annular link member (or formation) 106*a* is brought over the annular links of the preformed rope chain segment 107 until gap 119 substantially confronts opening 113. Annular link member 106*a* now takes an interlinking position with respect to terminal annular link 109 that two adjacent annular links on a rope chain would have with respect to each other. Annular link member 106*a* is then soldered (as representively shown by the numeral 15 and the associated arc) to terminal annular link 109. It is noted that the dots at the end of the arcs 15 depicted in the drawing do not specify the exact location of the solder on each link or component but only that the particular item is soldered to the other specified item denoted by the other dot. This mode of representation of solder joints is also used in other figures herein.

Figure 40:
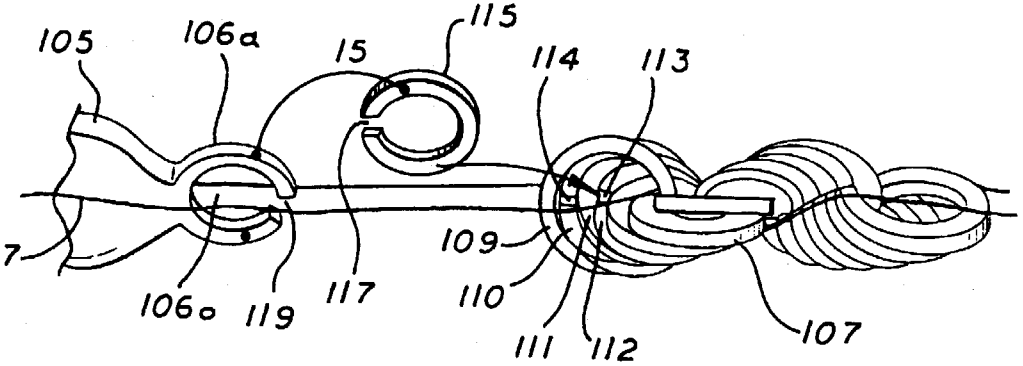
FIG. 40 depicts an alternative method of connecting the invention with a preformed rope chain segment where a connecting annular link is interlinked with the preformed rope chain segment, inserted into the invention and soldered.

FIG. 40 depicts an alternative method of connecting component 105 with a preformed rope chain segment. A connecting annular link 115 is threaded into opening 113 by bringing its gap 117 over the three annular links at the end of the preformed rope chain segment 107. The gap 117 is then preferably positioned outwardly toward component 105 by rotating the connecting annular link 115. The line leading from connecting annular link 115 and ending in an arrow indicator designating opening 113 is meant to show that annular link 115 is to be disposed in opening 113. (This mode of representation of where an annular link is to be interlinked is also used in other figures herein.) The connecting annular link 115 and the next three annular links (109, 110 and 111) of the rope chain segment are then brought through gap 119 and interlinked with annular link member (or formation) 106*a* as if it were the next annular link in the sequence. The central opening 106*o* of annular link member 106*a* and the central opening 115*o* of connecting annular link 115 will overlap. Preferably, the gap 119 of annular link member 106*a* will be disposed adjacent to annular link 111. The interlinked component 105, the connecting annular link 115, and the rope chain segment 107 are then held in place by working wire 27. When the chain has been thusly fashioned and the various elements are in place, annular link member 106*a* is soldered to connecting annular link 115, as denoted by numeral 15. Again, the drawing figures indicate what items are to be soldered together and not the exact location of where the solder 15 is to be applied.

FIG. 41 is a schematic representation of a manner of connecting component 105 with individual annular links 4, as opposed to a finished rope chain segment. The annular links 4, with their gap orientation indicated, are interlinked with component 105 and each other, held in place with a working wire 27 until a length of chain is completed, and then soldered. The interlinking of the annular links with annular link member 106*a* and with each other is not described here as the procedure is consistent with what has been disclosed heretofore. FIG. 41 shows the annular link 121 as being in a closed position with respect to annular link member 106*a* and is soldered 15 to both annular link member 106*a* as well as the next annular link in the sequence 123.

FIG. 42 is a schematic representation showing annular link 121 being in an "open" position with respect to annular link member 106*a*. In other words, the gap 125 of annular link 127 is positioned toward annular link member 106*a*. In this case, annular link 127 need only be soldered 15 to annular link member 106*a* to prevent the chain from unraveling.

FIG. 43 is a view of an embodiment of the component wherein annular link members 133, 135 are integrally provided on each end of the component but wherein one annular link member 133 on one end of the component is "closed" and the annular link member 135 on the other end is open.

FIG. 44 is a view of a full turn spiral component embodiment of the present invention having an elongated connecting means 137 at each end. The elongated connecting means 137 allow the placement of more than one annular link therewithin and its use has already been described with respect to FIGS. 9–11.

FIGS. 45–48 illustrate several methods of connecting a finished rope chain segment to a component having a closed rope chain member 133.

Figure 45:
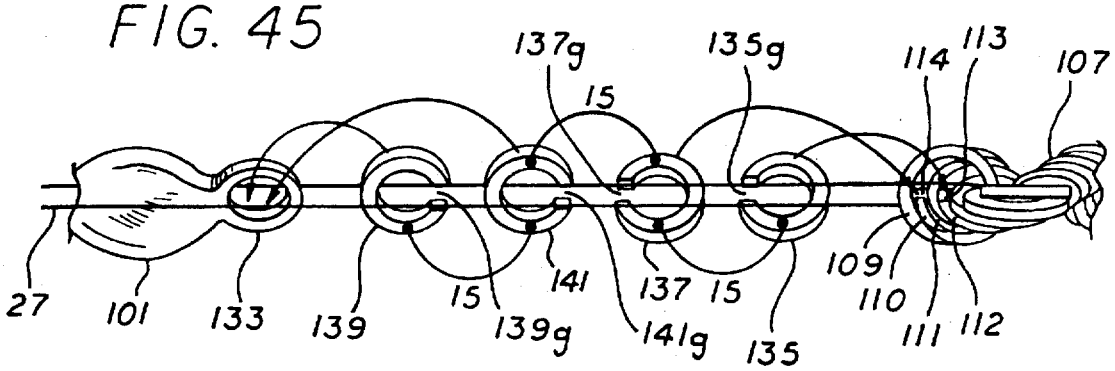
FIG. 45 is a view of a manner orienting and soldering connecting annular links when attaching a finished rope chain segment with a component having closed connecting means formed on an end. The working wire is schematically depicted.

FIG. 45 illustrates a method of connecting a rope chain component to a finished rope chain segment 107 by orienting and soldering four "connecting" annular links 135, 137, 139, and 141 therebetween. In this embodiment, a component 101 having a closed annular link member 133 is used. A finished rope chain segment 107 is brought toward closed annular link member 133. A first connecting annular link 135 is threaded through opening 113 and rotated until its gap **135*g* is oriented toward component 101. A second connecting annular link 137 is threaded through opening 114 and rotated until its gap 137*g* is oriented toward component 101. A third connecting annular link 139 is threaded through closed annular link member 133 and rotated until its gap 139*g* is oriented toward rope chain segment 107. A fourth connecting annular link 141 is threaded through closed annular link member 133 and rotated until is gap 141*g* is oriented toward rope chain segment 107. Connecting annular links 135 and 137 are then brought towards annular links 139 and 141 and interlinked through their respective gaps, 135*g*, 137*g*, 139*g* and 141*g*, thus connecting finished rope chain segment 107 with component 101. The four connecting annular links 135, 137, 139 and 141 take positions with respect to annular link member 133, to the annular links of the rope chain segment 107 and with respect to each other so that the links sequentially and positionally generally form a conventional rope chain. It should be noted that in this embodiment that is depicted in FIG. 45, the interlinking of connecting annular link 135 in opening 113 and its neighbor, connecting annular link 137, in opening 114, results in a slight spacing between annular link 135 and annular link 137. This spacing is due to the absence of any annular link that might otherwise be located between connecting annular links 135 and 137 and which would have its gap adjacent to annular link 111. The omission of this additional annular link helps save time and labor in the manufacture of the chain. However the general position and sequence of the remaining annular links are substantially maintained and the absence of such annular link from the sequence may not be so crucial so as to interrupt the continuity of line. In addition, the fact that the orientation of gaps 137*g* and 141*g* are each opposite their usual positions does not affect the appearance of the chain. In general, the heloidical form of the rope chain is continued by the added segments. When the chain has been fashioned, with the working wire 27 holding the parts of the chain in place, annular link 135 is soldered 15 to annular link 137, annular link 137 to annular link 141, and annular link 141 to annular link 139**.

Figure 46:
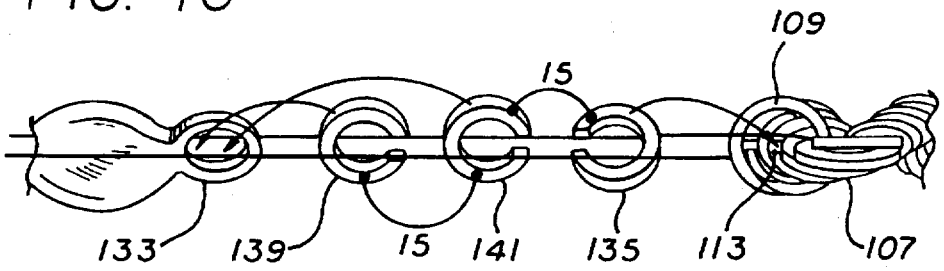
FIG. 46 is a view of another manner of orienting and soldering connecting annular links when attaching a finished rope chain segment with a component having a closed connecting means formed on an end.

FIG. 46 is a view of another method of connecting a rope chain component to a finished rope chain segment 107. Here only three "connecting annular links" are used. This method is substantially like that method illustrated in FIG. 45 except that the second annular link 137 is not used. Annular link 135 is soldered 15 to annular link 141 and annular link 139 is soldered 15 to annular link 141. It is noted that an annular link otherwise having a gap adjacent to terminal annular link 109 is absent resulting in a slight spacing between annular link member 133 and connecting annular link 139. But like the embodiment illustrated in FIG. 45, this spacing is not deemed to substantially affect the appearance of the chain and the benefit of leaving out the missing annular link is the savings of time and labor during manufacture.

Figure 47:
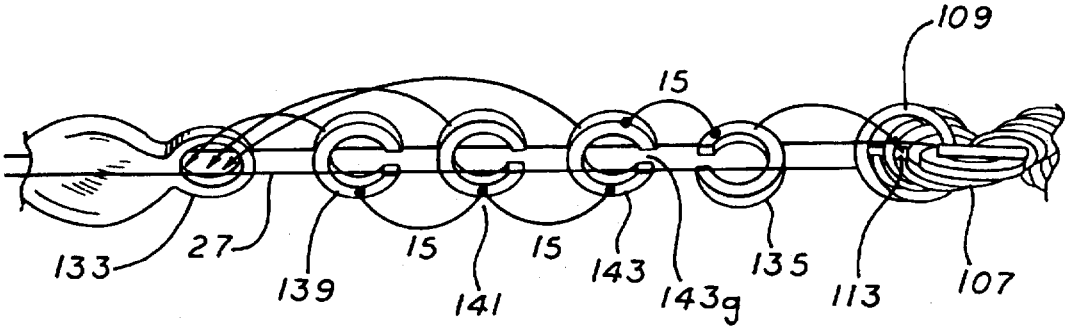
FIG. 47 is a view of a further manner of orienting and soldering connecting annular links when attaching a finished rope chain segment with a component having a closed connecting means formed on an end.

FIG. 47 is a view of yet another method of connecting a rope chain component to a finished rope chain segment 107 using four connecting annular links. Here annular link 135, as in the previous two constructions, is threaded through opening 113, and annular links 139 and 141 are likewise interlinked with closed annular link member 133. However another annular link 143, with its gap **143*g* toward rope chain segment 107, is threaded through closed annular link member 133 after annular link 141. Annular link 135 is soldered 15 to annular link 143, annular link 141 is soldered 15 to annular link 143, and annular link 139 is soldered 15 to annular link 141**.

Figure 48:
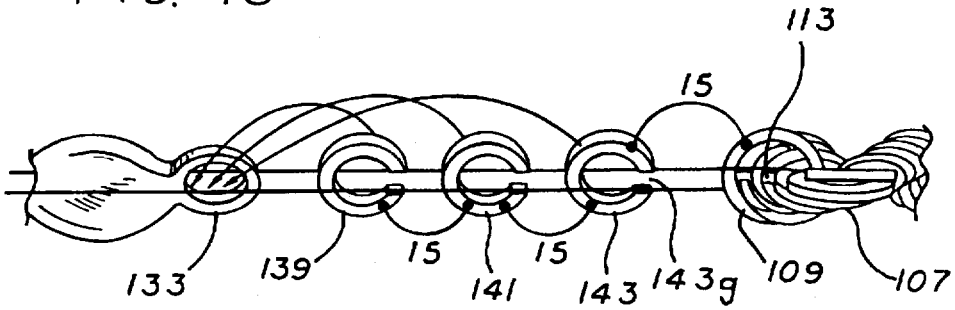
FIG. 48 is a view of another manner of orienting and soldering connecting annular links when attaching a finished rope chain segment with a component having a closed connecting means formed on an end.

FIG. 48 illustrates another method of connecting a rope chain component to a finished rope chain segment 107. This method is similar to that illustrated by FIG. 47 except that annular link 135 is not utilized. The three connecting annular links 139, 141 and 143 are each interlinked through closed annular link member 133. Gap **143*g* is brought to confront opening 113 and annular link 143 is soldered 15 to terminal annular link 109 of the rope chain segment 107, annular link 139 is soldered 15 to annular link 141, which in turn is soldered 15 to annular link 143. With gap 143*g* confronting opening 113, there should be spacing either between connecting annular links 141 and 143, between connecting annular links 139 and 141, or between annular link member 133 and connecting annular link 139, depending on the desired disposition and location of the three connecting annular links. Preferably, gap 143*g* will confront opening 113, gap 141*g* will confront a portion of annular link 111 and gap 139*g* will confront opening 114** as this arrangement will provide the chain with its tightest fit.

Figure 49:
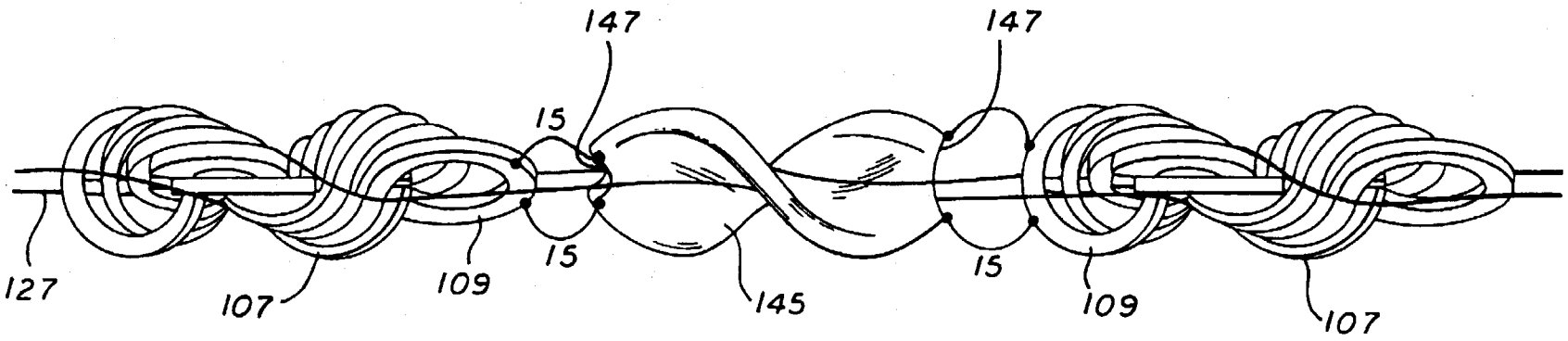
FIG. 49 shows an embodiment of the component where an end of the component is rounded to accommodate the periphery of an annular link of a finished rope chain segment.

FIG. 49 illustrate a different method of manufacturing a rope chain using an embodiment of the component 145 where the ends 147 of the component 145 have been rounded to accommodate the periphery of a terminal annular link 109 of a finished rope chain segment 107. The component 145 is made so that the diameter of the curvature of the end 147 is substantially the same as the outside diameter of the annular link 109. The finished rope chain segment 107 is bought to the component 145 so that the periphery of annular link 109 abuts to end 147. The component 145 and finished rope chain segment 107 are held in place with respect to each other by working wire 27. Solder 15 is applied to permanently bond the component 145 to finished rope chain 107.

Figure 50:
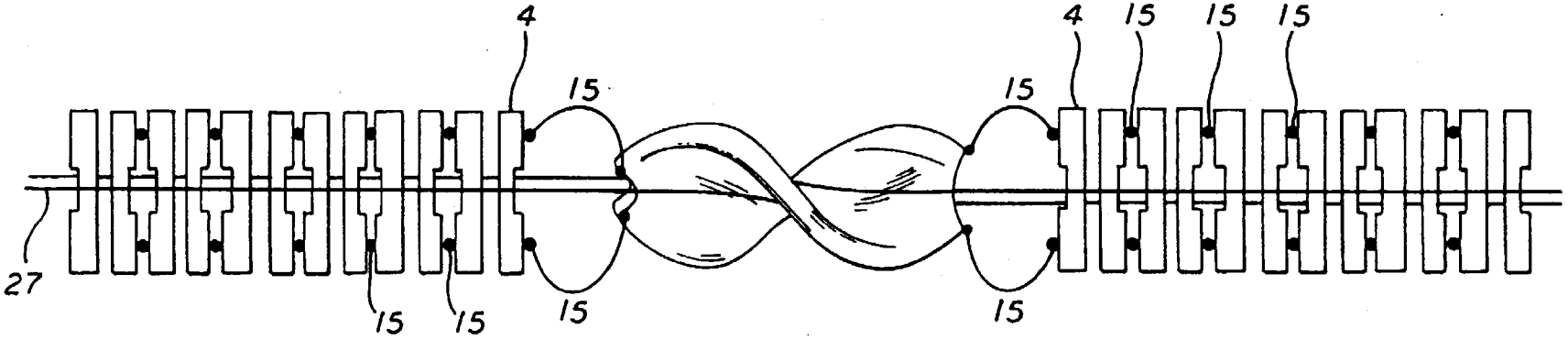
FIG. 50 is a schematic representation of the fashioning of a rope chain by connecting the component of FIG. 49 with individual annular links, holding the rope chain together during manufacture by a working wire, and applying solder thereafter.

FIG. 50 is a schematic representation another manner of forming a rope chain with component 145. Here the component 145 is integrated with individual annular links 4 and the component and annular links 4 are held in place with working wire 27 as successive annular links 4 are added and interlinked with the chain to fashion the rope chain. After a length of the chain has been completed using the component 145 and individual annular links 4, solder 15 is applied between the component 145 and the annular link 4 adjacent to it and between each two annular links as described above.

Figure 51:
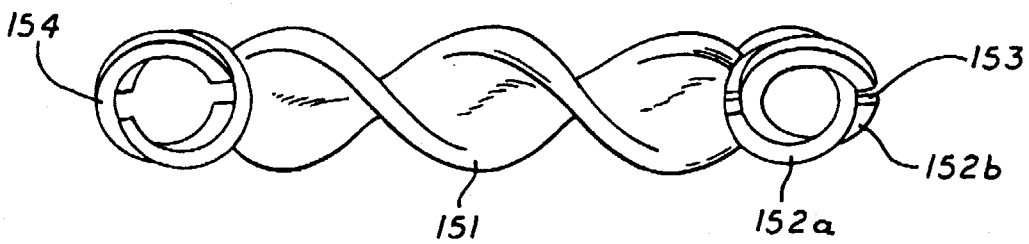
FIG. 51 is a schematic representation of the fashioning of a rope chain by connecting a "full-turn" 360 degree component with individual annular links, holding the rope chain together during manufacture by a working wire, and applying solder thereafter.

FIG. 51 is a schematic representation of the manner of forming a rope chain depicted in FIG. 50, but here the rope chain component 149 is a full-turn (360 degree) component as opposed to the half-turn (180 degree) component pictured in FIGS. 49 and 50. It is noted that the annular link 4 abutting end 147 can be either in an open or closed position and thus both gap orientations are illustrated in FIG. 51. The link's gap orientation affects the gap orientation of the annular link adjacent to it.

Figure 52:
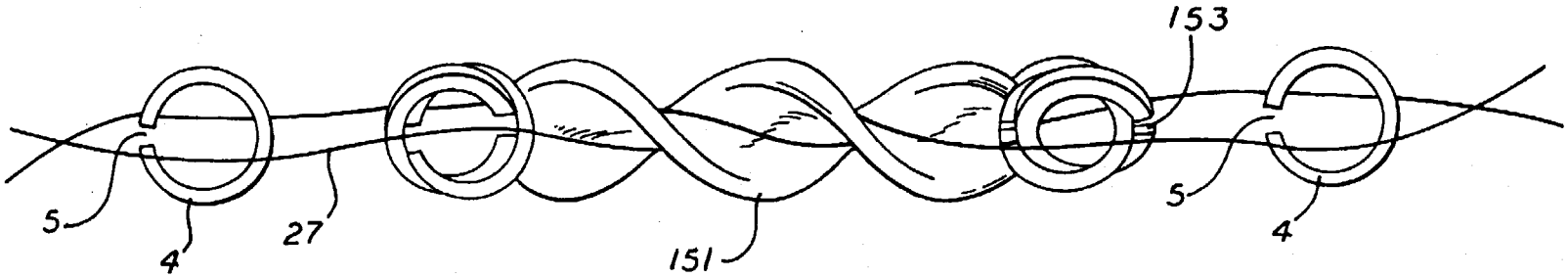
FIG. 52 illustrates a "full-turn" 360 degree spiral component that has two simulated annular links formed on its ends.
Figure 53:
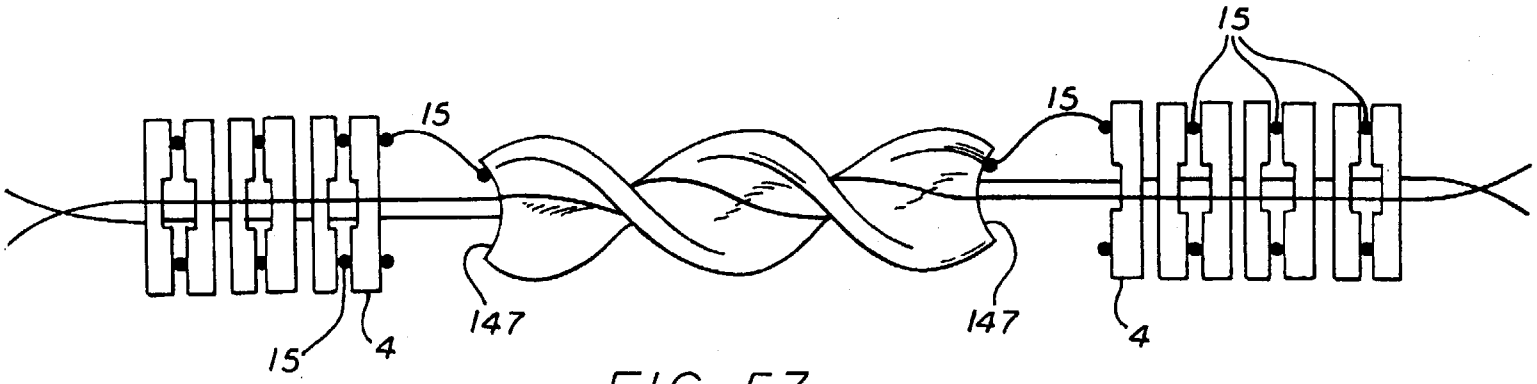
FIG. 53 illustrates the use of a single annular link to connect a finished rope chain segment with the component of FIG. 52.

FIG. 52 and FIG. 53 illustrate a "full-turn" spiral component 151 that has two simulated annular link members 152*a* and 152*b* precasted on its ends. The two precasted simulated annular members take positions with respect to each other substantially the same as two adjacent annular links on a conventional rope chain would have with respect to each other.

The component 151 is used to interlink with individual annular links 4 in a similar manner as described above regarding FIGS. 41 and 42, modified in certain respects by the gap orientation of the simulated annular link member on the end. Adjacent to the simulated annular link member 152*b* having the "open" configuration 153 (i.e. having the gap), the first annular link 4 will have its gap 5 oriented toward component 151. The rope chain is then fashioned in the conventional manner of forming a rope chain. Adjacent the simulated annular link member 154 having the closed configuration (i.e. without the gap), the next annular link 4 will have its gap 5 oriented away from the component 151. The rope chain is then fashioned in the conventional manner. As the rope chain is being fashioned, working wire 27 will hold the components 151 and annular links 4 in place until a desired length of chain has been completed. Solder 15 is then applied between the component 151 and the annular link 4 adjacent to it and between each two annular links 4 as described above.

Figure 54:
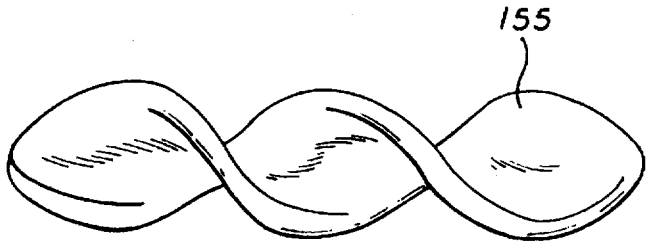
FIG. 54 is a view of a full-turn component without apertures on its ends.
Figure 55:
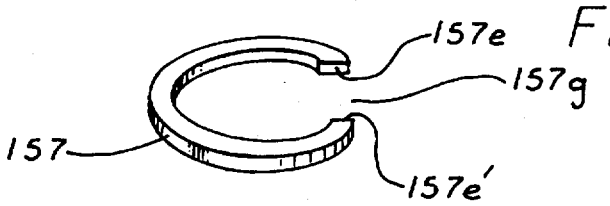
FIG. 55 illustrates an annular link with "off-set" ends for use with the full-turn component of FIG. 54.
Figure 56:
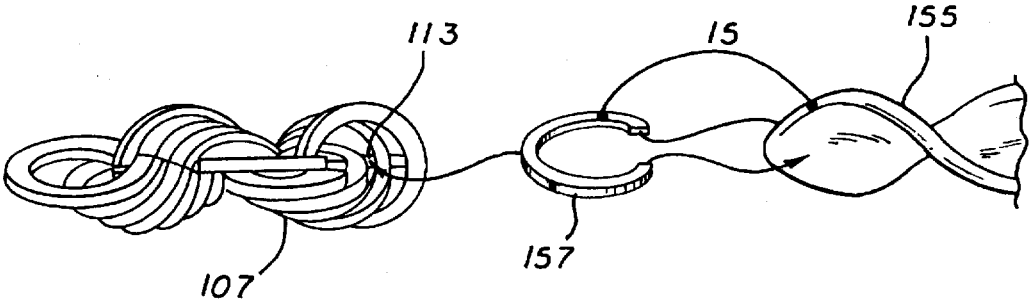
FIG. 56 shows the component of FIG. 54 being connected with a finished rope chain segment with an "off-set" connecting annular link.
Figure 57:
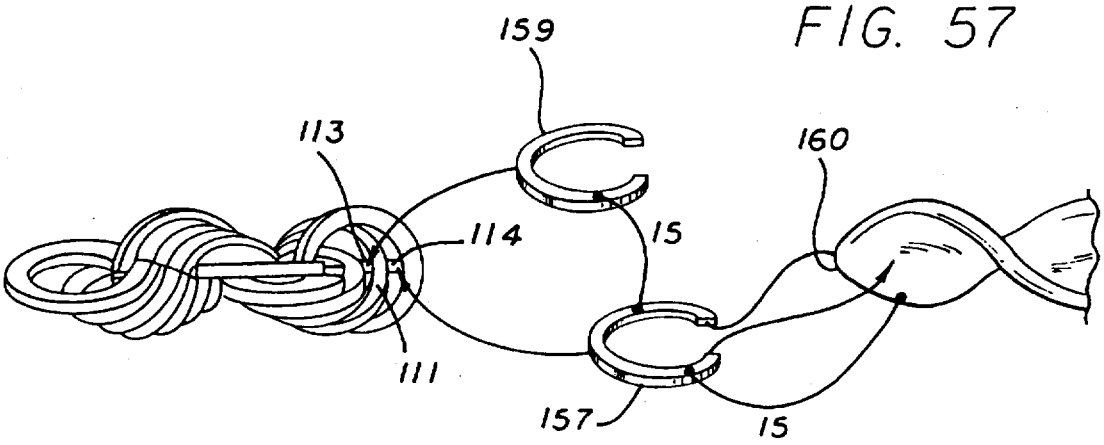
FIG. 57 shows the component of FIG. 54 being connected with a finished rope chain segment with two connecting annular links.

FIG. 54 depicts a component 155 and FIG. 55 depicts an "off-set" annular link 157 that are used in a method, illustrated in FIGS. 56 and 57, of attaching a finished rope chain segment 107 to the apertureless component 155. FIG. 54 is a view of the component 155 which is without apertures at its ends. FIG. 55 depicts an annular link 157 which is "off-set" so that the ends 157*e* of the annular link do not confront each other at the location of the gap 157*g*. The ends 157*e* and 157*e*' are offset laterally from each other so that they lie different planes and annular link 157 assumes a spiral shape. It is noted that the size of the gap 157*g* is exaggerated to better illustrate that the two ends 157*e* and 157*e*' are not in a confrontational relationship with each other.

In FIG. 56, offset annular link 157 is threaded through opening 113 of finished rope chain segment 107 and rotated until gap 157*g* is oriented toward apertureless component 155. This first offset annular link will eventually be soldered to apertureless component 155 as illustrated in FIG. 56. The "offset" ends of the offset annular link 157 serve to allow the offset annular link 157 to lay in a position conforming with the natural position it takes when part of a rope chain. It is noted that the reference to soldering 15 in the figures indicate that the offset annular link 157 is to be soldered 15 to the apertureless component 155; It does not necessarily indicate the exact location on the two components that the solder 15 is to be applied. Those skilled in the art will appreciate that the soldering is typically done by hand and thus the exact location of the solder is different for each soldering job done by hand.

FIG. 57 offers a variation of the method illustrated in FIG. 56 with the addition of a second offset annular link 159. Second offset annular link 159 is threaded through opening 113 and rotated until its gap 159*g* is oriented toward apertureless component 155. Offset annular link 157 is threaded through opening 114. Although it is not pictured, a working wire 27 may be utilized to firmly keep all elements of this chain in place until it is ready for soldering. Offset annular link 159 is then soldered to apertureless component 155 and offset annular link 159 is soldered to offset annular link 157. While offset annular link 159 may be soldered to apertureless component 157, this tends to decrease the flexibility of the chain and therefore it is not preferred to do so. It should be kept in mind the relationship of offset annular links 157 and 159 with respect to the other annular links of the finished rope chain segment 107 and the component 155: The individual annular links substantially maintain their sequence and position as they are sequentially and positionally comprised on a conventional rope chain. This allows the rope chain segment 107 to seemingly "meld" into the component 155. This continuity of line is maintained notwithstanding the fact that there may be some spacing between offset annular links 157 and 159 and an annular link with a gap adjacent to annular link 111 could be placed between offset annular links 157 and 159.

FIG. 58 provides a better view of the "offsetting" of the two ends, 157*e* and 157*e*', by placing offset annular link 159 adjacent to the end of component 155. As can be seen, the ends, 157*e* and 157*e*', are offset from each other and do not directly confront each other. In actual practice, the plane of the circle defined by the annular link would be tilted toward the general plane defined by the surface of the component near the end 160.

A component may have one aperture comprising its connecting means. An example is illustrated in FIG. 59. To provide better flexibility for the chain, an end can be truncated. FIG. 60 depicts component 161 having an aperture 163 and truncated end 165.

Component 161 can be attached to a finished rope chain segment 107 in much the same manner as described thus far. FIG. 61 shows component 161 and finished rope chain segment 107. A first connecting annular link 167 is first inserted into aperture 163 of component 161. it is rotated so that its gap 167*g* is oriented toward finished rope chain segment 107. Gap 167*g* is disposed adjacent opening 113. First connecting annular link 167 is then soldered 15 to terminal annular link 109 of finished rope chain segment 107. FIG. 62 shows a more preferable manner than that depicted in FIG. 61 of connecting component 161 with finished rope chain segment 107. Here first connecting annular link 167 is inserted into aperture 163 and it is rotated so that its gap 167*g* confronts third annular link 111 of rope chain segment 107. A second connecting annular link 169 is then intertwined through opening 113 and rotated so that its gap 169*g* is preferably oriented toward component 161 and interlinked with first connecting annular link 167. First connecting annular link 167 and second connecting annular link 169 are then soldered 15 together. The truncated end 165 allows room for movement of annular link 169 which makes for a more flexible chain.

FIG. 63 shows another embodiment of the component wherein a component 171 has a body 173, a truncated end 165, and an annular link 175 formed thereon. One end 175*e* of the annular link 175 does not adjoin the body of component 171 so that a gap 175*g* is defined between end 175*e* and body 173. The component 171 can be connected to a finished rope chain segment 107 by inserting the open annular link 175 into an opening 113 of the finished rope chain segment 107 and then closing gap 175*g* by soldering end 175*e* to the component body 173.

Turning now to FIG. 64, the foregoing method described and referenced to FIG. 63 may be modified by adding an additional connecting annular link 177 when connecting component 171 to the finished rope chain segment 107. When connecting annular link 177 is used, it is inserted into opening 113 and its gap is rotated until it is oriented toward component 171. Connecting annular link 175 is then inserted into opening 114 and gap 175*g* closed by soldering end 175*e* to the body 173 of component 171. Connecting annular link 177 is then soldered 15 to annular link member 175. This method of fashioning a chain may result in some spacing between terminal annular link 109 and connecting annular link 177. However because the other links maintain the continuity of line, the spacing is not deemed to substantially affect the appearance of the chain and the benefit of leaving out the missing annular link is the savings of time and labor during manufacture.

Component 171 can also be connected to individual annular links 4 to form a chain (as opposed to being connected to a finished rope chain segment 107). This is schematically illustrated in FIG. 65 and is much the same as previously described. Individual annular links 4 are interlinked with component 171, using annular link formation 175 as a first annular link in a series of annular links interlinked to form a rope chain. The component 171 and the annular links are held together by working wire 27 until a length of chain has been completed. Then, as already has been described, every two annular links 4 are soldered 15 together starting with annular link member 175 to the first annular link 179. End 175*e* is also soldered 15 to the body 173 of component 171.

Figure 66:
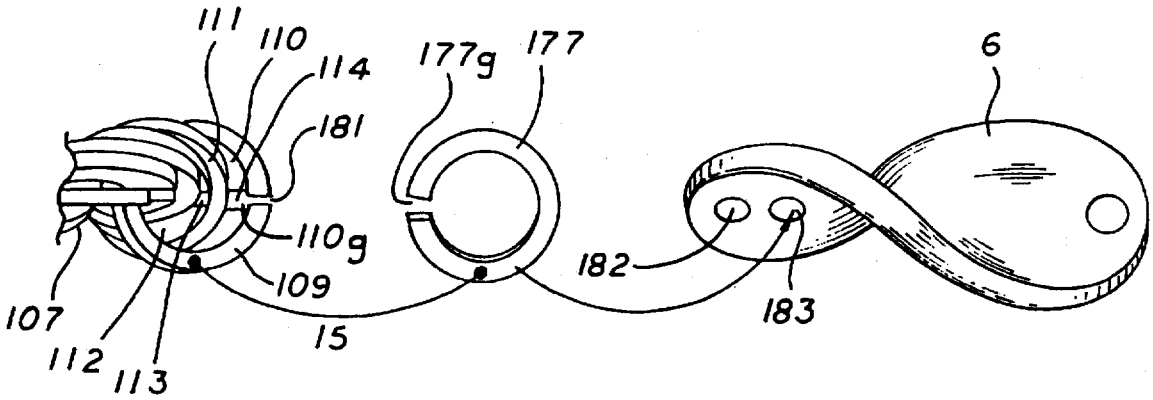
FIG. 66 illustrates a method of manufacturing a chain by taking a finished rope chain segment, forming a gap on the "closed" annular link at the end of the segment and inserting the component into the gap, and applying solder.

FIG. 66 illustrates another method of manufacturing a chain in accordance with the present invention and because it allows for the greatest savings in manufacturing and labor costs, it is considered the preferred embodiment. A finished rope chain segment 107 is preferably used and a narrow gap 181 is formed in the terminal annular link 109 at the end of the segment 107. The narrow gap 181 may be formed by applying a cut with a conventional wire cutter to the terminal annular link 109. The gap 181 should align with gap 110*g* of annular link 110 but it should be noted that gap 181 is preferably narrower than is gap 110*g* so that it can be more easily closed as will later be described. Connecting annular link 177 is inserted into aperture 183 of spiral component 6 and is rotated until its gap 177*g* is oriented toward the finished rope chain segment 107. The finished rope chain segment is then brought to component 6 by inserting gap 181 and gap 110*g* over the end of component 6. Preferably terminal annular link 109 is pinched when it is brought to a confronting position with respect to aperture 182 so that its gap 181 is narrowed further and possibly closed, thereby engaging terminal annular link 109 with aperture 182. Connecting annular link 177 is then soldered 15 to annular link 109.

Figure 66A:
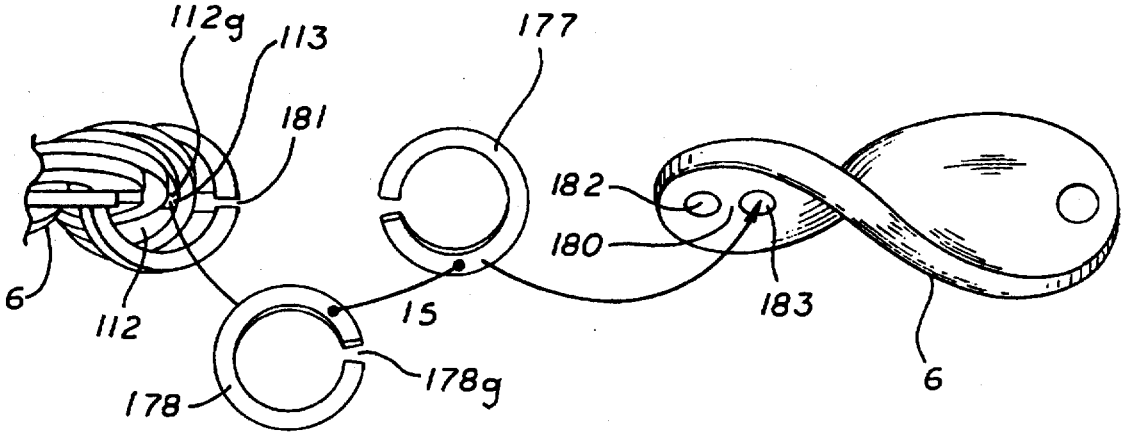
FIG. 66*a* illustrates a variation of the method of FIG. 66 wherein two connecting annular links are used to connect the finished rope chain segment to the component.

In a variation on this just-explained manner of manufacturing using the rope chain component, an additional connecting annular link 178 can be added. This is illustrated in FIG. 66*a*. Connecting annular link 178 is inserted into opening 113, which is defined by a gap 112*g* in annular link 112, and link 178 is rotated until its gap 178*g* is oriented toward the rope chain component 6. Connecting annular link 178 is interlinked with annular link 177 which has been inserted into aperture 183, as has been described with reference to FIG. 66, so that its gap 178*g* will rest over a membrane region 180 located between apertures 182 and 183. Gap 181 will confront aperture 182 and may be closed through aperture 182 as described with reference to FIG. 66. Connecting annular links 178 and 179 are then soldered together. The method illustrated in FIG. 66*a* may result in some spacing between connecting annular link 177 and connecting annular link 178. But again because the other links maintain the continuity of line, the spacing is not deemed to substantially affect the appearance of the chain and the benefit of leaving out the missing annular link is the savings of time and labor during manufacture.

Figure 67:
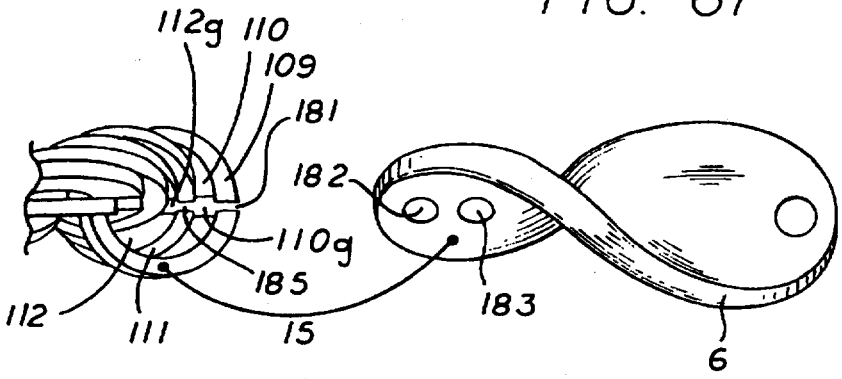
FIG. 67 illustrates a further method by taking a finished rope chain segment, forming a gap on the first and third annular links at the end of the segment and inserting the component into the gaps, and applying solder.

To save on additional labor costs in the manufacture of a rope chain using the spiral component, another narrow gap 185 can be formed on third annular link 111 of finished rope chain segment 107 as illustrated in FIG. 67. Narrow gap 185 can be formed on annular link 111 by applying a cut with a pair of wire cutters or similar instrument. Narrow gaps 181 and 185 align with the gaps, 110*g* and 112*g*, of the second and fourth annular links, 110 and 112, from the end of the finished rope chain segment 107, to form slot 187. Finished rope chain segment 107 can be "slid" into the end of component 6 so that gap 181 confronts aperture 183 and gap 185 confronts aperture 182. Annular links 109 and 111 can be pinched together to narrow gaps 181 and 185, confining the annular links 109 and 111 within apertures 183 and 182 respectively. Finished rope chain segment 107 is attached to component 6 by soldering annular link 109 to component 6.

To this point, we have described the fashioning of a chain using a component with connecting means that promotes the integration of the component with the conventional rope chain by substantially receiving onto the component the individual links of the rope chain in their ordinary sequence and position as those links are sequentially and positionally comprised on a conventional rope chain. Although the "cut and slide" method illustrated in FIGS. 66 and 67 removes a portion of one or two annular links, the result is still that the annular links on the chain are intertwined in an interlinked relationship with a neighboring annular link such that they are positioned with respect to each other as neighboring annular link on a conventional rope chain are substantially positioned. The orientation of the gaps of the annular links can be varied. The invention maintains the positions of the annular links in a reticular manner substantially like that in a conventional rope chain. This integration of the rope chain segment into the rope chain segment enhances the line-continuation from rope chain segment to component to rope chain segment, etc. The rope chain segment seems to "meld" into the component, minimizing the appearance of distinct individual units on the chain. In certain cases, an annular link may be absent from the conventional sequence. However, the general position and sequence of the remaining annular links are substantially maintained and the absence of such annular link from the sequence may not be so crucial so as to interrupt the continuity of line.

Figure 74:
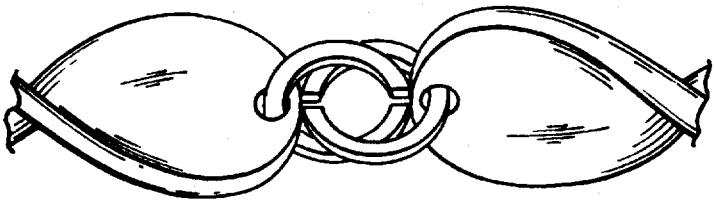
FIG. 74 illustrates the assembly of the two components with the two annular links of FIG. 68.

A similar effect can be obtained by connecting two components using only two annular links. FIG. 68 shows the fashioning of a rope chain by using only two annular links between two components. Components 201 and 205 are pictured with annular links 211 and 213. Annular link 211 has central opening 211*o* and annular link 213 has central opening 213*o*. Component 201 has an aperture 203 therein and a membrane portion 202 and component 205 has an aperture 207 therein and a membrane portion 206. Annular link 211 is inserted into aperture 203 and rotated until its gap 211*g* is oriented toward component 205. Similarly annular link 213 is inserted into component 205 and rotated until its gap 213*g* is oriented toward component 201. Annular link 211 and annular link 213 are then brought together and interlinked through their respective gaps 211*g* and 213*g*. The openings 211*o* and 213*o* are brought together in close alignment, with a portion of annular link 211 brought to an adjacent position to membrane 206 and a portion of annular link 213 brought to an adjacent position to membrane 202. Annular link 211 and annular link 213 are then soldered together as indicated by numeral 15. FIG. 74 illustrates the two annular links 211 and 213 interlinked together and ready for soldering.

Alternatively, gap 211*g* of annular link 211 can be brought to an overlapping or confronting relationship to membrane 206 and gap 213*g* of annular link 213 can be brought to an overlapping or confronting relationship to membrane 202. This permits the openings 211*o* and 213*o* to be brought to even greater alignment. However the overlapping of a gap with a membrane, for example, gap 211*g* with a membrane 206 tends to restrict the movement of the annular link 211 with respect to the component 205, and thus the resulting chain will be less flexible compared to the embodiment of FIG. 74.

FIG. 69 shows the fashioning of a rope chain by using only two annular links between two components where one of the components 215 has an open notch 217 at an end sized to receive the periphery of annular link 211 and an aperture 219 to receive annular link 213. Notch 217 provides room for annular link 211 to move, resulting in additional flexibility for the resulting chain. The components and annular links illustrated in FIG. 69 are shown assembled in FIG. 75 ready for soldering.

Figure 70:
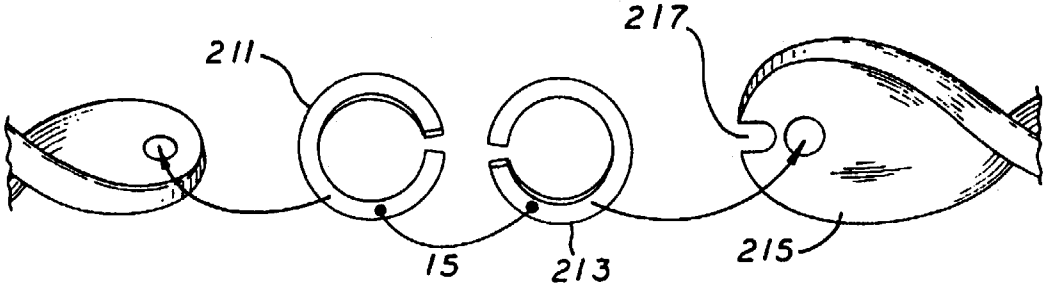
FIG. 70 depicts a manner of soldering the rope chain construction of FIG. 69 so that the annular link in the open aperture remains therein.
Figure 75:
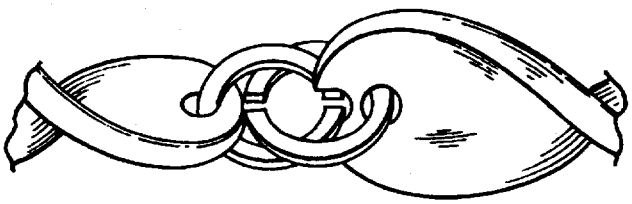
FIG. 75 illustrates the assembly of the two components with the two annular links of FIG. 69.

In the foregoing embodiments of FIGS. 69 and 75, flexing of the chain sometimes causes annular link 211 to displace from notch 215. The chain may crimp when annular link 211 abuts against the outer edge 221 of component 215, preventing annular link 211 from remaining disposed within notch 217. In addition to soldering annular link 211 to 214, if annular link 213 is also soldered to component 215, as shown in FIG. 70, annular link 211 will be firmly positioned within notch 217.

Figure 71:
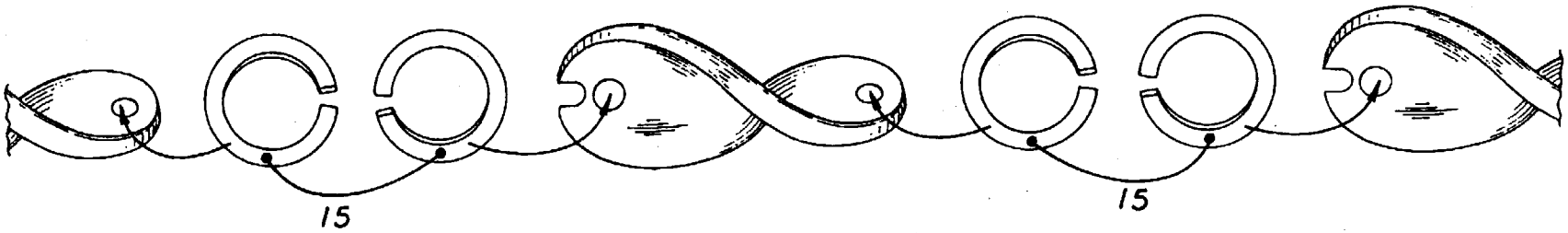
FIG. 71 shows a series of components connected by only two annular links between any two components.

A series of components may be connected by only two annular links between any two components. This is depicted in FIG. 71 and can result in substantial savings of manufacturing and labor costs.

Figure 72:
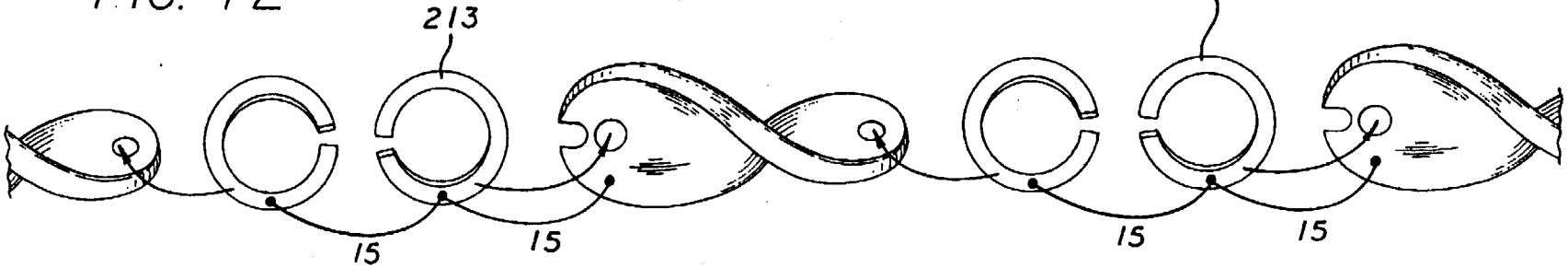
FIG. 72 shows a series of components connected by only two annular links between any two components but using a different arrangement of soldering.

FIG. 72 shows a series of components connected by only two annular links between any two components but using a different arrangement of soldering. As depicted in FIG. 70, annular link 213 may be soldered to component 215 to prevent crimping of the annular link 213 against component 215.

Figure 73:
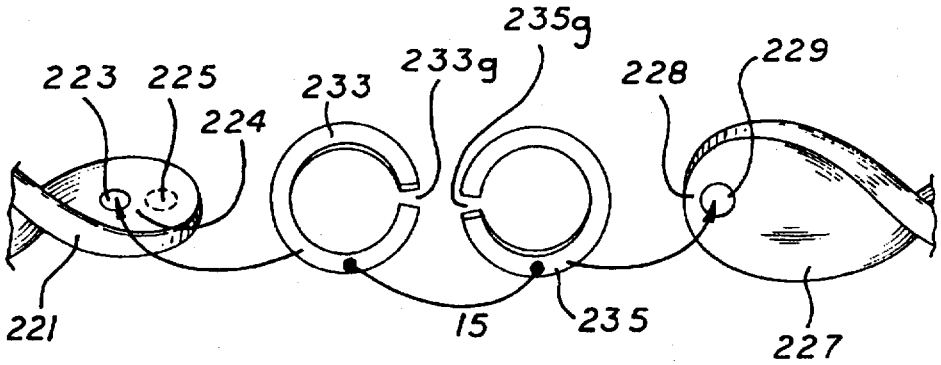
FIG. 73 depicts the connecting of two components with two annular links whereby one of the annular links is inserted into an aperture located further from the end of the component to provide the rope chain with a tighter arrangement for better continuity of line.
Figure 76:
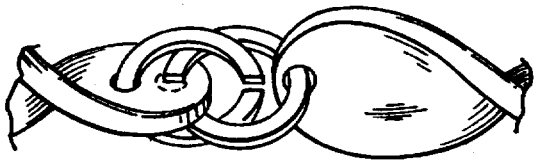
FIG. 76 illustrates the connection of FIG. 73.

FIG. 73 depicts the connecting of two components with two annular links whereby one of the annular links is inserted into an aperture located further from the end of the component to provide the rope chain with a tighter arrangement for better continuity of line. Component 221 is similar to the component depicted in FIG. 27. It has an inner aperture 223 and may or may not have aperture 225 which is rendered by a dotted line in FIG. 73. Component 221 has extended membrane portion 224 which is located between aperture 223 and the end of the component. Component 227 has aperture 229 and membrane portion 228. Annular link 233 is inserted into inner aperture 223 and rotated until its gap. 233*g* is oriented toward component 227. Annular link 235 is inserted into aperture 229 and rotated until its gap 235*g* is oriented toward component 221. Annular link 233 and annular link 235 are then brought together and interlinked through their respective gaps 233*g* and 235*g*. Gap 235*g* is brought to a confronting or overlapping relationship with membrane 224. Annular link 233 and annular link 235 are then soldered together. By overlapping gap 235*g* with membrane 224 of component 221, the two components 221 and 227 are pulled closer together, creating a tighter fit between the two components while at the same time preserving and even enhancing the continuity of line between the various annular links and components of the chain. FIG. 76 illustrates the two annular links 233 and 235 being interlinked together ready four soldering.

The drawings and the foregoing description are not intended to represent the only form of the invention in regard to the details of its construction and manner of operation. In fact, this apparatus and method can be adapted to a great many different situations. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claims:

The invention is claimed as follows:

1. Jewelry comprising annular links of the type used in forming a jewelry rope chain and a component for integration with said annular links, said component comprising a unitary body having connecting means at one end thereof for receiving a plurality of said annular links in a sequence and position corresponding to and maintaining the continuity of the sequence and position which said annular links take when formed into said jewelry rope chain.

2. A method of making jewelry comprising the steps of:

making a component for coupling with annular links of a jewelry rope chain, said component comprising a unitary body, said body having an end with connecting means formed thereon;

positioning a plurality of said annular links with said connecting means so that said annular links take respective positions in a sequence and position corresponding to and maintaining the continuity of the sequence and position which said annular links take when formed into said jewelry rope chain.

3. Jewelry comprising:

first and second components having at least one aperture therein with a membrane portion of each component being disposed between said at least one aperture and a peripheral edge of component;

first and second annular links, each link having a gap therein, a peripheral side, and a central opening, the first link passing through the aperture of the first component, the second link passing through the aperture of the second component, the periphery of the first link being disposed in an adjacent relationship with the membrane portion of the second component, the gap of the second link being disposed in an adjacent relationship with the membrane portion of the first component, said first and second annular links being fixed together with their central openings overlapping each other.

4. Jewelry comprising:

first and second components having at least one aperture therein with a membrane portion of each component being disposed between said at least one aperture and a peripheral edge of the component;

first and second annular links, each link having a gap therein and a central opening, the first link passing through the aperture of the first component, the second link passing through the aperture of the second component, the gap of the first link being disposed in a confronting relationship with the membrane portion of the second component, the gap of the second link being disposed in a confronting relationship with the membrane portion of the first component, said first and second annular links being fixed together with their central opening in substantial alignment.

5. A method of making jewelry by inter-connecting two rope chain components with two annular links, each annular link having a gap thereon, said method comprising:

providing a first component, said first component comprising a body having an end, an aperture, and a membrane portion located between said aperture and said end;

providing a second component, said second component comprising a body having an end, an aperture, and a membrane portion located between said aperture and said end;

inserting a first annular link into said first aperture and rotating said first annular link until the gap of said annular link is oriented away from said first component;

inserting a second annular link into said second aperture and rotating said second annular link until the gap of said second annular link is oriented away from said second component;

passing the first annular link through the second annular link so that the two links are inter-connected;

aligning the gap of the first annular link so that it abuts against the membrane portion of the second component and the gap of the second annular link so that it abuts against the membrane portion of the first component; and soldering said first annular link to said second annular link.

6. A method of making jewelry, said method comprising:

providing a component having a body and at least one annular link formation with a gap thereon and a central opening;

providing a finished rope chain segment, said rope chain segment having an opening provided by a gap of the fourth annular link from an end of said finished rope chain segment;

inserting a connecting annular link having a gap thereon and a central opening, and rotating said connecting link so that said gap is oriented away from said finished rope chain segment;

passing said gap of said connecting annular link through said annular link formation so that the connecting annular link is interlinked with said annular link formation;

positioning the central opening of said annular link formation with the central opening of said connecting annular link so that both said central openings substantially overlap; and soldering said annular link formation to said connecting annular link.

7. A method of making jewelry, said method comprising:

providing a component having a body and at least one annular link member with a gap thereon and a central opening;

providing a finished rope chain segment, said rope chain segment having an opening provided by the gap of the fourth annular link from an end of said finished rope chain segment;

passing said gap of said annular link member over said finished rope chain segment until said gap is substantially adjacent to said opening; and soldering said annular link member to said finished rope chain segment.

8. A method of making jewelry as claimed in claim 7 further comprising the step of positioning said annular link member adjacent to a terminal annular link of the finished rope chain segment so that its central opening substantially overlaps with a central opening of said terminal annular link.

9. A method of making jewelry, said method comprising:

providing a component having a body and at least one annular link member and a central opening;

interlinking a first annular link having a gap therein with said annular link member;

interlinking a second annular link having a gap therein by threading its gap through said annular link member and said first annular link;

interlinking a third annular link having a gap therein by threading its gap through said annular link member, said first annular link and said second annular link; and soldering said first annular link to said annular link member and said second annular link to said third annular link.

10. A method of making jewelry by interconnecting two rope chain components with two annular links, each annular link having a gap thereon, said method comprising:

providing a first component, said first component comprising a body having an edge, an aperture, and a membrane located between said aperture and said edge;

providing a second component, said second component comprising a body having an edge, an aperture, and a membrane located between said aperture and said edge;

inserting a first annular link having a gap into said first aperture and rotating said first annular link until said gap of said first annular link is oriented away from said first component;

inserting a second annular link having a gap into said second aperture and rotating said second annular link until the gap of said second annular link is oriented away from said second component;

passing said first annular link through said gap of said second annular link so that the two links are interlinked;

aligning said gap of said first annular link so that it is disposed adjacent to said membrane of said second component and said gap of said second annular link so that it is disposed adjacent to said membrane of said first component; and soldering said first annular link to said second annular link.

11. A method of making jewelry, said method comprising:

providing a component having a body and at least one annular link member with a gap therein;

providing a finished rope chain segment, said rope chain segment having an opening provided by a gap of a fourth annular link from an end of said rope chain segment;

inserting a connecting annular link having a gap therein into said opening and rotating said connecting annular link so that said gap is oriented away from said finished rope chain segment;

passing said gap of said connecting annular link through said annular link member and positioning the annular link member adjacent to said connecting annular link; and soldering said connecting annular link to said annular link member.

12. A jewelry chain comprising:

a component having an annular link member integrally formed thereon;

a finished rope chain segment, said rope chain segment comprising a terminal annular link at an end of said rope chain segment, a second annular link having a gap therein, said second annular adjacent to said terminal annular link, a third annular link having a gap therein, and a fourth annular link having a gap therein, said finished rope chain segment having an opening provided by said gap of said fourth annular link and an opening provided by said gap of said second annular link;

a first connecting annular link having a gap therein, a portion of said first connecting annular link disposed within said opening provided by said gap of said fourth annular link;

a second connecting annular link having a gap therein, a portion of said second connecting annular link disposed within said opening provided by said gap of said second annular link; and said first connecting annular link and said second annular link interlinked with said annular link member.

13. A jewelry rope chain as claimed in claim 12 further comprising a third connecting annular link and a fourth connecting annular link, said third and fourth connecting annular links being interlinked with said annular link member and also each interlinked with said first and second connecting annular links.

14. A jewelry chain comprising:

a component having an annular link member integrally formed thereon;

a finished rope chain segment, said rope chain segment comprising a terminal annular link at an end of said rope chain segment;

a first connecting annular link having a gap therein, said first connecting annular link interlinked with said annular link member in a sequential position adjacent to said annular link member;

a second connecting annular link having a gap therein, said second connecting annular link interlinked with said annular link member in a sequential position adjacent to said first connecting annular link; and said gap of said first connecting annular link disposed in a position confronting an annular link of said finished rope chain segment and said gap of said second connecting annular link disposed in a position confronting an annular link adjacent to said annular link confronted by said gap of said first connecting annular link.

15. A method of making jewelry, said method comprising:

providing a component having a body portion and at least one annular link member;

providing a finished rope chain segment, said rope chain segment having a terminal annular link located at an end, a second annular link that is one annular link removed from said terminal annular link and a fourth annular link that is three annular links removed from said terminal annular link, said second annular link having a gap therein that is exposed and said fourth annular link having a gap therein that is exposed;

interlinking a first connecting annular link having a gap therein with said annular link member, orienting its gap away from said body;

interlinking a second connecting annular link having a gap therein with said annular link formation, orienting its gap away from said body;

interconnecting a third connecting annular link having a gap therein with said finished rope chain segment by inserting said third connecting annular link through said gap of said fourth annular link and orienting said gap of said third connecting annular link away from said finished rope chain segment;

passing said gap of said third connecting annular link through said first and second connecting annular links and through said annular link member thereby interlinking said third connecting annular link with said first and second connecting annular links and with said annular link member; and soldering said third connecting annular link to said second connecting annular link and said first connecting annular link to said second connecting annular link.

16. A method of making jewelry, said method comprising:

providing a component having a body portion and at least one annular link member;

providing a finished rope chain segment, said rope chain segment having a terminal annular link located at an end, a second annular link that is two annular links from said end and a fourth annular link that is four annular links from said end;

interlinking a first connecting annular link with said annular link member;

interlinking a second connecting annular link with said annular link member, locating said second connecting annular link adjacent to said first connecting annular link;

interlinking a third connecting annular link with said annular link member, locating said third connecting annular link adjacent to said second connecting annular link;

passing said gaps of said first, second and third connecting annular links over said finished rope chain segment so that gaps are sequentially located in position away from said end of said finished rope chain segment; and soldering said first connecting annular link to said second connecting annular link and soldering said second connecting annular link to said third connecting annular link.

17. A method of making jewelry comprising the steps of:

providing a finished rope chain segment comprised of a plurality of annular links, said rope chain segment having a terminal annular link at an end, said terminal annular link having an outer radius;

providing a component, said component having an end that is curved, said curve having a radius that is substantially the same as said outer radius of said terminal annular link;

abutting said curved end of said component to a periphery of said terminal annular link; and soldering said curved end of said component to said terminal annular link.

18. A method of making jewelry comprising the steps of:

providing a first annular link, said first annular link having an outer radius;

providing a component, said component having an end that is curved, said curve having a radius that is substantially the same as the outer radius of said first annular link;

abutting said curved end of said component to a periphery of said first annular link;

fashioning a rope chain segment by interlinking a second annular link with said first annular link, interlinking a third annular link with said second and third annular links, and interlinking a fourth annular link with said second third and fourth annular links; and soldering said component to said first annular link.

19. A method of making jewelry, said method comprising:

providing a component having a body;

providing a finished rope chain segment, said rope chain segment having an opening provided by a gap of a fourth annular link from an end of said finished rope chain segment;

inserting a connecting annular link having a gap therein into said opening and rotating said connecting annular link so that said gap is oriented away from said fourth annular link;

passing said gap of said connecting annular link through said component; and soldering said connecting annular link to said component.

20. A method of making jewelry, said method comprising:

providing a component having a body;

providing a finished rope chain segment, said rope chain segment having a first opening provided by a gap of a fourth annular link from an end of said finished rope chain segment, and a second opening provided by a gap of a second annular link from an end of said finished rope chain segment;

inserting a first connecting annular link having a gap therein into said first opening and rotating said connecting annular link so that said gap is oriented away from said fourth annular link;

inserting a second connecting annular link having a gap therein into said second opening and rotating said second connecting annular link so that said gap is oriented away from said second annular link;

passing said gap of said first connecting annular link over said component;

soldering said first connecting annular link to said component; and soldering said second connecting annular link to said first connecting annular link.

21. A method of making jewelry comprising the steps of:

providing a rope chain component, said component having a main body and an annular link member formed on an edge thereof, said annular link member having a first end and a second end, said first end integrally formed on said component, said second end adjacent to but unattached to said component;

providing a finished rope chain segment comprised of a plurality of annular links, said rope chain segment having a terminal annular link at an end and an opening provided by a gap of one of said annular links;

integrating said finished rope chain segment with said annular link member by inserting said second end of said annular link member through said opening; and soldering said annular link member to said terminal annular link.

22. A method of making jewelry as claimed in claim 17 wherein said opening is provided by a gap of a third annular link from said terminal annular link.

23. A method of making jewelry comprising the steps of:

providing a rope chain component, said component having a main body and an annular link member formed on an edge thereof, said annular link member having a first end and a second end, said first end integrally formed on said component, said second end adjacent to but unattached to said component;

providing a finished rope chain segment comprised of a plurality of annular links, said rope chain segment having a terminal annular link at an end and an opening provided by a gap of a fourth annular link from said end and an opening provided by a gap of a second annular link from said end;

interlinking a connecting annular link having a gap therein with said finished rope chain segment by inserting said connecting annular link into said opening of said fourth annular link and rotating said gap so that it is oriented away from said fourth annular link;

integrating said finished rope chain segment with said annular link member by inserting said second end of said annular link member through said opening of said second annular link;

passing said gap of said connecting annular link through said annular link member; and soldering said annular link member to said connecting annular link.

24. A method of making jewelry comprising the steps of:

providing a rope chain component, said component having a main body and an annular link member formed on an edge thereof, said annular link formation having a first end and a second end, said first end integrally attached to component, said second end adjacent to but unattached to said component;

taking a first annular link and interlinking said first annular link to said annular link member;

fashioning a rope chain segment with a plurality of annular links by first interlinking a second annular link with said first annular link and said annular link member, and interlinking a third annular link with said first annular link, said second annular link and said annular link member; and soldering said annular link member to said first annular link.

25. A jewelry chain comprising:

a component having an aperture formed therein;

a finished rope chain segment, said rope chain segment comprising a terminal annular link located at an end of said rope chain segment, and a plurality of other annular links; and a connecting annular link interlinked with said component through said aperture, said connecting annular link having a gap, said gap disposed adjacent to one of said other annular links; and a bonding element between said connecting annular link and said finished rope chain segment.

26. A method of making jewelry, said method comprising:

providing a component having a an aperture formed therein;

providing a finished rope chain segment, said rope chain segment comprising a terminal annular link located at an end of said rope chain segment, and a plurality of other annular links;

interlinking a connecting annular link having a gap by inserting said connecting annular link through said aperture;

passing said gap of said connecting annular link over said terminal annular link so that said gap is adjacent to one of said other annular links; and bonding said connecting annular link to said finished rope chain segment.

27. A method of making jewelry as claimed in claim 26 wherein said passing step is further comprised of positioning said gap adjacent to a fourth annular link located from said end prior to taking said bonding step.

28. A jewelry chain comprising:

a component having an aperture formed therein, said component having an edge;

a finished rope chain segment, said rope chain segment comprising a terminal annular link located at an end of said rope chain segment, a plurality of other annular links, and an opening provided by a gap in a fourth annular link from said end;

a first connecting annular link interlinked with said component through said aperture, said first connecting annular link having a gap;

a second connecting annular link, said second annular link having a gap, said second annular link interlinked with said finished rope chain segment through said opening; and said first connecting annular link interlinked with said second annular link so that said gap of said second annular link is disposed adjacent to said edge and said gap of said first annular link is disposed adjacent to one of said other annular links.

29. A method of making jewelry, said method comprising:

providing a component having an aperture formed therein, said component having an edge;

providing a finished rope chain segment, said rope chain segment comprising a terminal annular link located at an end of said rope chain segment, and a plurality of other annular links;

interlinking a first connecting annular link having a gap by inserting said connecting annular link through said aperture;

interlinking a second connecting annular link with said finished rope chain segment;

passing said gap of said connecting annular link over said terminal annular link so that said gap is adjacent to one of said other annular links;

disposing said gap of said second annular link so that its gap is located adjacent to edge; and bonding said first connecting annular link to said second connecting annular link.

30. A method of making jewelry, said method comprising:

providing a component having a first aperture and a second aperture formed therein, said component having an edge and a membrane portion located between said first aperture and said edge;

providing a finished rope chain segment, said rope chain segment comprising a terminal annular link located at an end of said rope chain segment, a second annular link disposed adjacent to said terminal annular link, and a plurality of other annular links;

interlinking a connecting annular link having a gap through said second aperture;

forming a gap on said terminal annular link;

passing said gap of said terminal annular link over said membrane portion until said gap confronts said first aperture and passing said gap of said connecting annular link over said finished rope chain segment until said gap of said connecting annular link is disposed adjacent to said finished rope chain segment; and bonding said connecting annular link to said finished rope chain segment.

31. A method of making jewelry as claimed in claim 30 further comprising the step of narrowing said gap of said terminal annular link so that said terminal annular link is securely disposed within said first aperture before said bonding step.

32. A method of making jewelry, said method comprising:

providing a component having a first aperture and a second aperture formed therein, said component having an edge and a membrane portion located between said first aperture and said edge;

providing a finished rope chain segment, said rope chain segment comprising a terminal annular link located at an end of said rope chain segment, a second annular link having a gap, said second annular link located adjacent to said terminal annular link, a third annular link disposed adjacent to said second annular link, and a fourth annular link having a gap, said fourth annular link located adjacent to said third annular link;

forming a gap on said terminal annular link and forming a gap of said third annular link so that said gaps of said terminal annular, second annular link, third annular link and fourth annular link are aligned in a substantially linear alignment;

passing said linear alignment over said membrane until said gap of said terminal annular link confronts said second aperture and said gap of said third annular link confronts said first aperture; and bonding said finished rope chain segment to said component.

33. A method of making jewelry as claimed in claim 32 further comprising the step of narrowing said gap of said terminal annular link within said second aperture so that said terminal annular link is securely disposed within said second aperture before said bonding step.

34. A method of making jewelry as claimed in claim 32 further comprising the step of narrowing said gap of said third annular link within said first aperture so that said third annular link is securely disposed within said first aperture before said bonding step.

* * * * *